US010184235B2

(12) United States Patent
Goldsmith

(10) Patent No.: US 10,184,235 B2
(45) Date of Patent: Jan. 22, 2019

(54) DIRECTIONAL FLUID INLET

(71) Applicant: Falcon Waterfree Technologies, LLC, Los Angeles, CA (US)

(72) Inventor: Edward Michael Goldsmith, Encino, CA (US)

(73) Assignee: FALCON WATERFREE TECHNOLOGIES, LLC, Los Angeles, CA (US)

( * ) Notice: Subject to any disclaimer, the term of this patent is extended or adjusted under 35 U.S.C. 154(b) by 454 days.

(21) Appl. No.: 14/289,451

(22) Filed: May 28, 2014

(65) Prior Publication Data

US 2014/0352045 A1 Dec. 4, 2014

Related U.S. Application Data

(60) Provisional application No. 61/929,124, filed on Jan. 20, 2014, provisional application No. 61/828,169, filed on May 28, 2013.

(51) Int. Cl.
*E03C 1/28* (2006.01)

(52) U.S. Cl.
CPC ..... *E03C 1/281* (2013.01)

(58) Field of Classification Search
CPC ... E03C 1/281; E03C 1/29; E03D 5/01; E03D 13/005; E03D 13/007
USPC ..... 4/144.1, 301
See application file for complete search history.

(56) References Cited

U.S. PATENT DOCUMENTS

| | | | |
|---|---|---|---|
| 1,745,010 | A | 1/1930 | De Lamprecht |
| 2,675,823 | A | 4/1954 | Langdon |
| 3,047,013 | A | 7/1962 | Baumbach |
| 3,967,645 | A | 7/1976 | Gregory |

(Continued)

FOREIGN PATENT DOCUMENTS

| | | |
|---|---|---|
| AU | 8303367 | 9/2008 |
| AU | 8303368 | 9/2008 |

(Continued)

OTHER PUBLICATIONS

International Search Report and The Written Opition of The International Searching Authority for PCT/US2014/039831; dated Sep. 24, 2014.

*Primary Examiner* — Christine Skubinna
(74) *Attorney, Agent, or Firm* — Tope-McKay & Associates

(57) ABSTRACT

A fluid inlet portion for a waterless urinal cartridge is presented. The fluid inlet portion comprises to fluid director comprising a non-linear surface proximate a throat portion of the cartridge formed to impart a horizontal velocity component to fluid flowing through the throat portion of the cartridge to reduce vertical turbulence within the fluid. The fluid director can be formed so that it is in fluid communication with at least part of a fluid layer within the cartridge. The non-linear surface imparts a horizontal velocity component, thereby reducing disruption of the fluid layer by fluid flowing through the throat portion of the cartridge. The fluid director may be positioned within the cartridge to impart a substantially horizontal swirling motion to fluid within the cartridge. A fluid deflector proximate the fluid director can receive fluid from the fluid deflector and for re-directing the fluid from the fluid director.

5 Claims, 21 Drawing Sheets

(56) References Cited

U.S. PATENT DOCUMENTS

| | | | |
|---|---|---|---|
| 4,518,014 | A | 5/1985 | McAlpine |
| 4,574,400 | A | 3/1986 | Annowsky |
| 4,574,403 | A | 3/1986 | Dintemann et al. |
| 4,578,207 | A | 3/1986 | Holdt et al. |
| 4,595,346 | A | 6/1986 | Bozoyan |
| 4,683,071 | A | 7/1987 | Holdt et al. |
| 4,937,892 | A | 7/1990 | Syrenne |
| 5,193,585 | A | 3/1993 | Proffitt et al. |
| 5,581,823 | A | 12/1996 | Kuo |
| 5,604,937 | A | 2/1997 | Davenport |
| 5,606,995 | A | 3/1997 | Raftis |
| 5,711,037 | A | 1/1998 | Reichardt et al. |
| 5,727,593 | A | 3/1998 | Duer |
| 5,813,058 | A | 9/1998 | Quigley et al. |
| 6,009,567 | A | 1/2000 | Dean et al. |
| 6,053,197 | A | 4/2000 | Gorges |
| 6,105,916 | A | 8/2000 | Zlotnik et al. |
| 6,247,189 | B1 | 6/2001 | Dean et al. |
| 6,286,153 | B1 | 9/2001 | Keller |
| 6,401,266 | B1 | 6/2002 | Mitchell et al. |
| 6,425,411 | B1 | 7/2002 | Gorges |
| 6,640,356 | B1 | 11/2003 | Hans |
| 6,644,339 | B2 | 11/2003 | Gorges et al. |
| 6,701,541 | B2 | 3/2004 | Romagna et al. |
| 6,750,773 | B2 | 6/2004 | Higgins |
| 6,959,723 | B2 | 11/2005 | Gorges |
| 6,973,939 | B2 | 12/2005 | Gorges et al. |
| 6,977,005 | B2 | 12/2005 | Erdmann et al. |
| D544,574 | S | 6/2007 | Cummings |
| 7,243,681 | B2 | 7/2007 | Dahm |
| 7,422,034 | B2 | 9/2008 | Dahm |
| 7,511,004 | B2 | 3/2009 | Cheung et al. |
| D598,523 | S | 8/2009 | McAlpine |
| D598,987 | S | 8/2009 | McAlpine |
| 7,571,741 | B2 | 8/2009 | Higgins |
| 7,575,022 | B2 | 8/2009 | Higgins |
| 7,636,957 | B2 | 12/2009 | Funari |
| 7,709,433 | B2 | 5/2010 | Veltman et al. |
| D618,322 | S | 6/2010 | Keller |
| D620,584 | S | 7/2010 | McAlpine |
| 7,757,312 | B2 | 7/2010 | Stack et al. |
| 7,900,288 | B2 | 3/2011 | Fima |
| 8,006,324 | B2 | 8/2011 | Ophardt et al. |
| 8,007,707 | B1 | 8/2011 | Brown et al. |
| D644,717 | S | 9/2011 | Larkin et al. |
| 8,234,723 | B2 | 8/2012 | Allen |
| 8,277,715 | B2 | 10/2012 | Arora et al. |
| 8,291,522 | B2 | 10/2012 | Kueng |
| 8,444,771 | B2 | 5/2013 | Leipold et al. |
| 8,485,216 | B2 | 7/2013 | Higgins |
| 8,510,875 | B2 | 8/2013 | Helbig et al. |
| 8,590,068 | B2 | 11/2013 | Stack et al. |
| 8,646,117 | B2 | 2/2014 | Avetisian |
| 2002/0069913 | A1 | 6/2002 | Gorges et al. |
| 2002/0116753 | A1 | 8/2002 | Mitchell et al. |
| 2002/0120981 | A1 | 9/2002 | Gorges |
| 2003/0089397 | A1 | 5/2003 | Gorges |
| 2004/0010843 | A1 | 1/2004 | Erdmann et al. |
| 2004/0134534 | A1 | 7/2004 | Gorges et al. |
| 2004/0181861 | A1 | 9/2004 | Inglin et al. |
| 2004/0211267 | A1 | 10/2004 | Higgins |
| 2005/0229297 | A1 | 10/2005 | Higgins |
| 2005/0229971 | A1 | 10/2005 | Higgins |
| 2005/0247342 | A1 | 11/2005 | Higgins |
| 2006/0064805 | A1 | 3/2006 | Yamamoto et al. |
| 2006/0101565 | A1 | 5/2006 | Cummings |
| 2006/0118176 | A1 | 6/2006 | Ring et al. |
| 2006/0207005 | A1 | 9/2006 | Janssen |
| 2006/0225195 | A1 | 10/2006 | Scholer |
| 2007/0006370 | A1 | 1/2007 | Schroder |
| 2007/0048247 | A1 | 3/2007 | Martin et al. |
| 2007/0083989 | A1 | 4/2007 | Higgins et al. |
| 2007/0186337 | A1 | 8/2007 | Emr |
| 2007/0209979 | A1 | 9/2007 | Helbig et al. |
| 2007/0257218 | A1 | 11/2007 | Bood et al. |
| 2008/0028504 | A1* | 2/2008 | Higgins ..... E03C 1/281 4/144.1 |
| 2008/0093845 | A1 | 4/2008 | Higgins |
| 2008/0256695 | A1 | 10/2008 | Allen |
| 2008/0269097 | A1 | 10/2008 | Cheung et al. |
| 2008/0295233 | A1 | 12/2008 | Fima |
| 2008/0303186 | A1 | 12/2008 | Lu |
| 2008/0313795 | A1 | 12/2008 | Lu |
| 2009/0165197 | A1 | 7/2009 | Seibt |
| 2009/0235443 | A1 | 9/2009 | Arora et al. |
| 2010/0024892 | A1 | 2/2010 | Higgins |
| 2010/0095445 | A1 | 4/2010 | Rice et al. |
| 2010/0120648 | A1 | 5/2010 | Veltman et al. |
| 2010/0186156 | A1 | 7/2010 | Ophardt et al. |
| 2010/0192291 | A1 | 8/2010 | Burt et al. |
| 2010/0192295 | A1 | 8/2010 | Fima |
| 2010/0199412 | A1 | 8/2010 | McAlpine |
| 2010/0199415 | A1 | 8/2010 | Fima |
| 2010/0205725 | A1 | 8/2010 | McAlpine |
| 2010/0230333 | A1 | 9/2010 | Avetisian |
| 2011/0010833 | A1 | 1/2011 | Fima |
| 2011/0016619 | A1 | 1/2011 | Keller |
| 2011/0036417 | A1 | 2/2011 | McAlpine |
| 2011/0203048 | A1 | 8/2011 | Fima |
| 2011/0209276 | A1 | 8/2011 | Lu et al. |
| 2011/0219528 | A1 | 9/2011 | Cadavid |
| 2011/0223059 | A1 | 9/2011 | Lu et al. |
| 2011/0252552 | A1 | 10/2011 | Janssen |
| 2011/0296597 | A1 | 12/2011 | Brown et al. |
| 2012/0023649 | A1* | 2/2012 | Helbig ..... E03C 1/28 4/144.1 |
| 2012/0066822 | A1 | 3/2012 | Kueng |
| 2012/0167295 | A1 | 7/2012 | Fima |
| 2012/0228800 | A1 | 9/2012 | Arora et al. |
| 2012/0317707 | A1 | 12/2012 | Romero |
| 2013/0000766 | A1 | 1/2013 | McAlpine et al. |
| 2013/0015388 | A1 | 1/2013 | Keller |
| 2013/0031708 | A1 | 2/2013 | Sensel |
| 2013/0067651 | A1 | 3/2013 | Brown et al. |
| 2013/0104305 | A1 | 5/2013 | Stack et al. |

FOREIGN PATENT DOCUMENTS

| | | |
|---|---|---|
| AU | 10320652 | 11/2010 |
| AU | 11235550 | 3/2011 |
| CA | 2700702 | 4/2009 |
| CA | 2700704 | 4/2009 |
| CA | 2786552 | 5/2011 |
| CN | 2386089 | 8/1999 |
| CN | 2559699 | 7/2003 |
| CN | 2656515 | 11/2004 |
| CN | 2699813 | 5/2005 |
| CN | 2781131 | 5/2006 |
| CN | 101260686 A | 9/2008 |
| CN | 201198591 | 2/2009 |
| CN | 201343756 | 11/2009 |
| CN | 101260686 | 6/2010 |
| CN | 201649272 | 11/2010 |
| CN | 201843191 | 5/2011 |
| CN | 201843210 | 5/2011 |
| CN | 102425223 | 4/2012 |
| CN | 202273300 | 6/2012 |
| CN | 102635151 | 8/2012 |
| CN | 202577519 | 12/2012 |
| DE | 362324 | 7/1920 |
| EP | 0 916 774 A2 | 11/1996 |
| EP | 0 916 774 A3 | 11/1996 |
| EP | 1 174 549 | 1/2002 |
| EP | 1 174 549 A2 | 1/2002 |
| EP | 1 174 549 A3 | 1/2002 |
| EP | 1 785 077 | 5/2007 |
| EP | 2 472 014 | 6/2013 |
| GB | 0422136 | 7/1933 |
| GB | 0468282 | 12/1935 |
| GB | 0520277 | 8/1938 |
| GB | 0718597 | 3/1951 |
| GB | 0725125 | 11/1953 |
| GB | 0915103 | 7/1961 |
| GB | 1006930 | 10/1961 |

(56) References Cited

FOREIGN PATENT DOCUMENTS

| | | | |
|---|---|---|---|
| GB | 1006945 | | 4/1962 |
| GB | 1103425 | | 5/1965 |
| GB | 1103426 | | 5/1965 |
| GB | 1203608 | | 12/1967 |
| GB | 2 153 048 | | 8/1985 |
| GB | 153 048 | | 8/1985 |
| GB | 2 190 466 | | 11/1987 |
| GB | 2 296 309 | | 6/1996 |
| GB | 2 320 310 | | 6/1998 |
| GB | 2 346 198 | | 2/2000 |
| GB | 2 346 198 | | 12/2002 |
| GB | 2467669 | A | 8/2010 |
| GB | 2469585 | A | 10/2010 |
| GB | 2 470 839 | A | 12/2010 |
| GB | 2473055 | | 3/2011 |
| GB | 2488664 | | 9/2012 |
| GB | 2 470 839 | B | 1/2013 |
| GB | 2467669 | B | 2/2013 |
| GB | 2469585 | B | 2/2013 |
| JP | 49 5434 | | 4/1972 |
| JP | 6316672 | | 7/1988 |
| JP | 1993090063 | | 4/1993 |
| JP | 2002 047718 | | 2/2002 |
| JP | 04905434 | | 1/2012 |
| JP | 05090063 | | 12/2012 |
| KR | 877603 | | 1/2009 |
| KR | 2010013602 | | 2/2010 |
| KR | 2010076858 | | 7/2010 |
| KR | 10 1051882 | | 7/2011 |
| NZ | 0543551 | | 11/2005 |
| NZ | 0586547 | | 6/2010 |
| RU | 2010130666 | A | 12/2006 |
| WO | WO 99/07953 | | 2/1999 |
| WO | WO 99/57382 | | 11/1999 |
| WO | WO 01/45075 | | 6/2001 |
| WO | WO 2004059198 | | 7/2004 |
| WO | 2004/090245 | | 10/2004 |
| WO | WO 2004/100742 | | 11/2004 |
| WO | WO 2007 149379 | | 12/2007 |
| WO | WO 2009/026733 | | 3/2009 |
| WO | WO 2009/040524 | | 4/2009 |
| WO | WO 2009/040525 | | 4/2009 |
| WO | WO 2009/081155 | | 7/2009 |
| WO | WO 2009/144479 | | 12/2009 |
| WO | WO 2010/074411 | | 1/2010 |
| WO | WO 2010/067049 | | 6/2010 |
| WO | WO 2010/091862 | | 8/2010 |
| WO | WO 2011/012860 | | 2/2011 |
| WO | WO 2011/061515 | | 5/2011 |
| WO | WO 2011/094880 | | 8/2011 |
| WO | WO 2011/120177 | | 10/2011 |
| WO | WO 2011/120178 | | 10/2011 |
| WO | WO 2011/120179 | | 10/2011 |
| WO | WO 2012/117221 | | 9/2012 |
| WO | WO 2013/017373 | | 2/2013 |
| WO | WO 2013/017424 | | 2/2013 |
| ZA | 198303028 | A | 4/1983 |

* cited by examiner

DIRECTIONAL FLUID INLET

CROSS-REFERENCE TO RELATED APPLICATIONS

This application claims the benefit of U.S. Provisional Application No. 61/929,124, filed Jan. 20, 2014, titled "Directional Fluid Inlet" and U.S. Provisional Application No. 61/828,169, filed May 28, 2013, titled "Wrap Around Baffle with Vented Cone Shaped Top."

BACKGROUND OF THE INVENTION (1) Field of the Invention

The present invention relates to waterless urinals and, more particularly, to waterless urinal cartridges that include a mechanism for reducing the turbulence and/or splashing of fluids entering the cartridge in order to reduce precipitant buildup and to assist in cleaning.

(2) Description of Related Art

Water is a scarce and diminishing resource in many areas of the world. It is widely recognized that more has to be one to conserve its usage as populations grow and climates change. Water conserving products are becoming more and more important not only for quality of human life but also for sanitary and subsistence reasons.

There have been many water conserving measures taken all over the world in an effort to deal with limited and diminishing resources. Many municipalities have developed, rationing plans. Others have invested in waste water recycling treatment and re-use. There have also been many water-conserving products introduced into the marketplace. These products are being more widely used by industry and homeowners as regulations become stricter and the costs of water usage rise.

The non-flushing urinal designs use far less water than the traditional urinals, saving up to 40,000 gallons of water per year just from a single urinal. The non-flushing urinals are made of three major components: a porcelain urinal, a housing, and a cartridge. The porcelain urinal component is very similar to a traditional urinal. The housing replaces a traditional P-trap which normally would connect the urinal to the building's plumbing. Thus, the housing is placed in-line between the building's plumbing and the bottom of the urinal where the drain pipe would normally connect. The cartridge operates as the P-trap and fits in the housing in a sealed air-tight manner, and can be removed for servicing and replacement.

A liquid trap-style cartridge serves two purposes. First, it acts as a barrier from sewer gasses and odors coming into the restroom. Second, it acts as a filter; removing some of the solids that precipitate from the human urine (which is a super saturated liquid). The human urine is an aqueous solution of greater than 95% water, with the remaining constituents, in order of decreasing concentration being urea 9.3 g/L, chloride 1.87 g/L, sodium 1.17 g/L, potassium 0.750 g/L, creatinine 0.670 g/L, and other dissolved ions, inorganic and organic compounds according to the NASA Contractor Report No. NASA CR-1802, D. F. Putnam, July 1971.

The liquid trap-style cartridge works by using two mechanisms. First, urine fills the P-trap of the cartridge, forming a barrier against sewer gasses—just as the water does in a traditional P-trapped urinal. Second, a layer of low density fluid, such as oil, can be poured into the trap so that it floats on top of the urine. This floating fluid forms a barrier keeping unpleasant urine smells from entering the bathroom.

As a user urinates into the urinal, fresh urine enters the cartridge, sinks through the floating fluid barrier, and presses the old urine out of the trap and out through the housing exit tube and into the building's plumbing. Thus it is critical for the fluid barrier to stay intact so it remains floating above the urine in the cartridge to keep foul smells from entering the restroom. If urine encounters the fluid barrier with either too much velocity or in too high a volume, the fluid that forms the barrier may be broken up into small particles and washed out with the urine.

Though there are a significant water saving benefits from using non-flushing urinals, some drawbacks exist. One of the most significant is the formation of struvite in the pipes, the housing, and the cartridge. Struvite (magnesium ammonium phosphate) is a phosphate mineral with formula: $NH_4MgPO_4.6H_2O$. Struvite crystallizes in the orthorhombic system as white to yellowish or brownish-white pyramidal crystals or in platy mica-like forms. It is a soft mineral with a Mohs hardness of 1.5 to 2 and has a low specific gravity of 1.7. It is sparingly soluble in neutral and alkaline conditions, but readily soluble in acidic conditions. In some cases, formation of struvite in the cartridge can be beneficial, as struvite formed in the cartridge is struvite not deposited in the housing or the pipes. The cartridge is designed to be easily replaceable, thus its action as a filter is a benefit.

The manner in which struvite or other solids build up inside the cartridge is important, as the flow of new fluids (both flushing fluids and urine) is affected by where buildup occurs. While flushing urinals also produce buildup in the pipes, there it tends to be of more of a hard, calcified nature. With the non-flushing urinals, it has been found that struvite formation is more common, particularly in areas of slow velocity flows or high splash (both of which cause struvite to precipitate out of solution from the urine).

Struvite can also build up in the pipes of the plumbing lines, which are downstream from the cartridge. It is often desirable to flush these pipes out with fresh water; however to do so can be onerous, as it requires the removal of the cartridge prior to dumping a bucket of water into the urinal. This is to avoid flushing the protective floating oil barrier that prevents odor from entering the user environment. The lighter-than-urine barrier cannot withstand the dumping of high volumes of fluid into the traditional cartridge designs (for e.g., when a bucket of water is dumped into the cartridge) because the fluid entering the cartridge at high velocity impinges on the oil and breaks it up into small particles, flushing the oil through the cartridge.

Codes and regulations in many countries also affect cartridge design. In the United States, for example, the plumbing code typically requires a two inch vertical liquid barrier to sewer gasses. Thus, unless another component provides the trap action, the cartridge must be designed to hold a two inch column of water in order to comply with the plumbing code. Because the trap area is the area most likely to have struvite sediment clog it, it is advantageous for the cartridge (which is easily replaceable) to be the component that provides this two inch gas sealing water column as required by the plumbing code.

There are a number of different designs of the liquid trap cartridges. All United States code-compliant models utilize a 2" deep water column to block sewer gas while some utilize a central exit and some utilize a side exit. Code compliant cartridges similar to those made by Falcon Waterfree Technologies (located at 2255 Barry Avenue, Los Angeles, Calif. 90064, USA) use a central inlet for fluid to enter and a side or a back exit for the fluid to exit the cartridge. Others, like the cartridge manufactured and sold under the Waterless brand (Waterless Co., 1050 Joshua Way, Vista, Calif. 92081, USA) utilize inlets spaced away from the center and closer to the perimeter of the cartridge, and a central cartridge, exit.

Various methods for trying to retain oil exist in the market today. However, none avoid the action of impingement and breaking up the oil into smaller, more soluble particles, which are easily flushed through the cartridge. Examples of solutions heretofore presented in the art include, but are not limited to, the mechanism shown in U.S. Pat. No. 6,425,411, which has a deflector siting above the inlet compartment's fluid level and the mechanism of Korean Patent No. KR20100013602A, which utilizes a deflector-like shelf within the cartridge fluid level. Neither of these solutions effectively prevents strong impingement of urine with the barrier fluid layer.

Thus, there is a need for a better non-flush cartridge inlet system. It is therefore desirable to provide waterless urinal cartridges that include a mechanism for reducing the turbulence and/or splashing of fluids entering, the cartridge in order to maintain the integrity of the barrier fluid layer and to reduce precipitant buildup and to assist in cleaning.

BRIEF DESCRIPTION OF THE DRAWINGS

The objects, features and advantages of the present invention will be apparent from the following detailed descriptions of the various aspects of the invention in conjunction with reference to the following drawings, where.

SUMMARY OF THE INVENTION

Figure 1A:
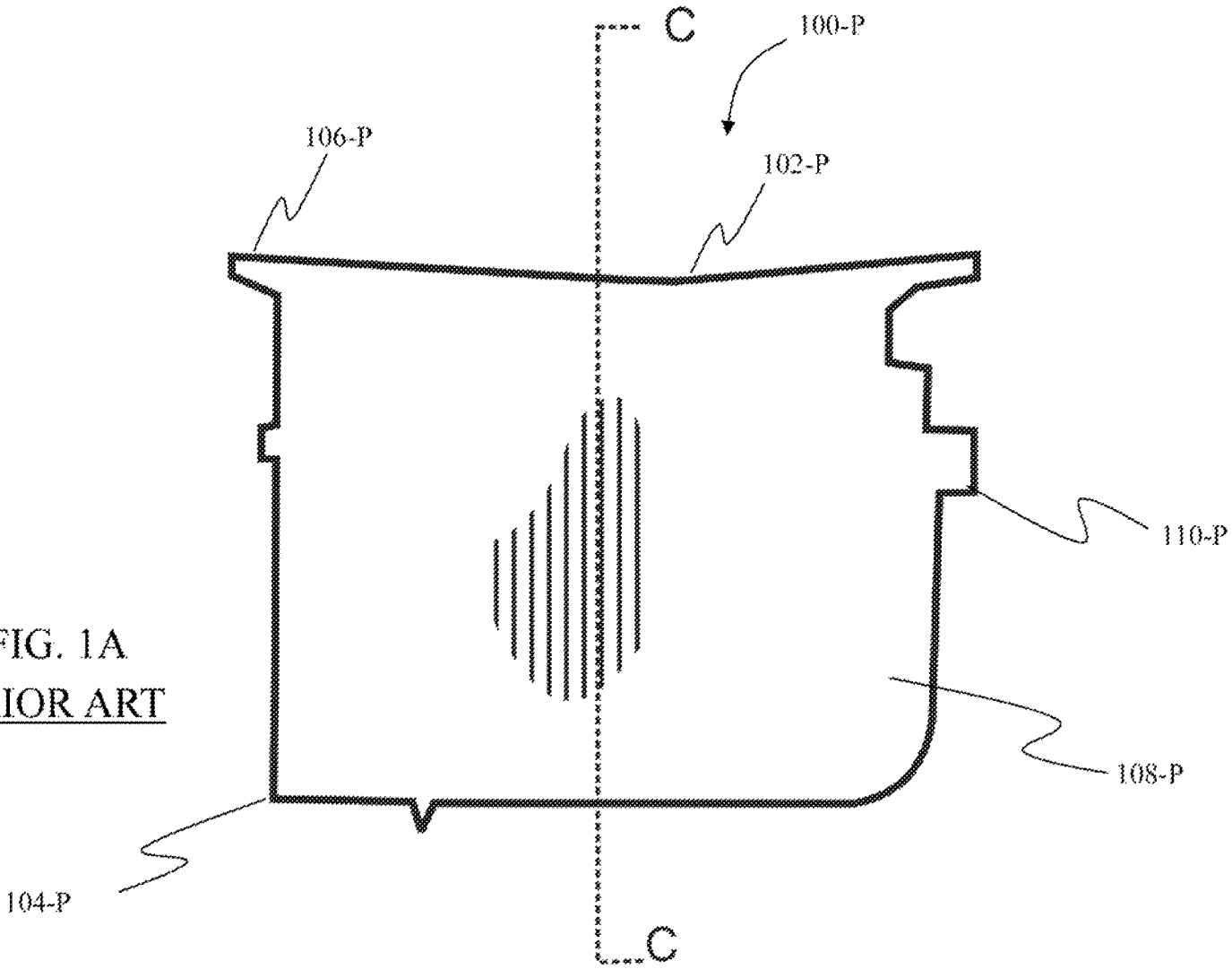
FIG. 1A PRIOR ART
FIG. 1A is side view illustration of a prior art liquid trap cartridge for a waterless urinal.

The present invention relates to waterless urinals and, more particularly, to waterless urinal cartridges that include a mechanism for reducing the turbulence and/or splashing of fluids entering the cartridge in order to reduce precipitant buildup and to assist in cleaning.

In a first aspect, the present invention teaches a fluid inlet portion for a waterless urinal cartridge comprising a fluid director. The fluid director comprises a non-linear surface proximate a throat portion of the cartridge, formed to impart a horizontal velocity component to fluid flowing through the throat portion of the cartridge to reduce vertical turbulence within the fluid.

In another aspect, the fluid director is formed such that it is in fluid communication with at least a portion of a fluid layer within the cartridge. The non-linear surface is formed to impart a horizontal velocity component to fluid flowing through the throat portion of the cartridge, thereby reducing disruption of the fluid layer by fluid flowing through the throat portion of the cartridge.

In still another aspect, the fluid director is configured to direct fluid flowing through the throat portion of the cartridge in a substantially uniform direction.

In yet another aspect, the fluid director comprises a surface-type selected from a group consisting of convex and concave.

In a further aspect, the fluid director is positioned within the cartridge to impart a substantially horizontal swirling motion to fluid within the cartridge.

In a still further aspect, the fluid inlet portion further comprises a fluid deflector proximate the fluid director for receiving fluid from the fluid deflector and for re-directing the fluid from the fluid director.

In a yet further aspect, the fluid deflector deflects the fluid from the fluid director with a further horizontal component.

In another aspect, the fluid deflector deflects a portion of the fluid from the fluid director with an upward vertical velocity component and a portion of the fluid from the fluid director with a downward vertical velocity component.

In still another aspect, the fluid deflector resides below a surface of the barrier fluid layer.

In yet another aspect, the cartridge further comprises a vertical separator wall for retaining fluid within the cartridge and where the fluid deflector is formed with a gap between the fluid deflector and the vertical separator.

In a further aspect, the cartridge further comprises a cartridge body wall for retaining fluid within the cartridge and where the fluid deflector is formed with a gap between the fluid deflector and the cartridge body wall.

In a still further aspect, the present invention teaches a fluid inlet portion for a waterless urinal cartridge where the fluid inlet portion comprises a fluid deflector and a vertical separator wall. A gap exists between the fluid deflector and the vertical separator wall and the fluid deflector receives fluid from a throat portion of the cartridge and imparts a horizontal velocity component to fluid flowing through the throat portion of the cartridge.

In a yet further aspect, the fluid deflector is formed such that it is in fluid communication with at least a portion of a fluid layer within the cartridge. The fluid deflector is formed to impart a horizontal velocity component to fluid flowing through the throat portion of the cartridge, thereby reducing disruption of the fluid layer by fluid flowing through the throat portion of the cartridge.

In another aspect, the deflector comprises a non-horizontal surface.

In still another aspect, the deflector comprises a non-linear surface.

In a further aspect, the cartridge further comprises a cartridge body wall for retaining fluid within the cartridge and where the fluid deflector is formed with a gap between the fluid deflector and the cartridge body wall.

Finally, as can be appreciated by one in the art, the present invention also comprises a method for forming and using the invention described herein.

DETAILED DESCRIPTION

The present invention relates to waterless urinals, and more particularly to waterless urinal cartridges that include a mechanism to reduce the splashing of fluids entering, the cartridge in order to reduce precipitant buildup and to assist in cleaning.

The following description is presented to enable one of ordinary skill in the art to make and use the invention and to incorporate it in the context of particular applications. Various modifications, as well as, a variety of uses in different applications will be readily apparent to those skilled in the art, and the general principles defined herein may be applied to a wide range of embodiments. For example, the individual components described may be formed as discrete parts or integrated together as a single unit. Thus, the present invention is not intended to be limited to the embodiments presented, but is to be accorded the widest scope consistent with the principles and novel features disclosed herein.

In the following detailed description, numerous specific details are set forth in order to provide a more thorough understanding of the present invention. However, it will be apparent to one skilled in the art that the present invention may be practiced without necessarily being limited to these specific details. In other instances, well-known structures and devices are shown in block diagram form, rather than in detail, in order to avoid obscuring the present invention.

The reader's attention is directed to all papers and documents which are filed concurrently with this specification and which are open to public inspection with this specification, and the contents of all such papers and documents are incorporated herein by reference. All the features disclosed in this specification, (including any accompanying claims, abstract, and drawings) may be replaced by alternative features serving the same, equivalent or similar purpose, unless expressly stated otherwise. Thus, unless expressly stated otherwise, each feature disclosed is one example only of a generic series of equivalent or similar features.

Furthermore, any element in a claim that does not explicitly state "means for" performing a specified function, or "step for" performing a specific function, is not to be interpreted as a "means" or "step" clause as specified in 35 U.S.C. Section 112, Paragraph 6. In particular, the use of "step of" or "act of" in the claims herein is not intended to invoke the provisions of 35 U.S.C. 112, Paragraph 6.

Before describing the invention in detail, an introduction is provided to give the reader a general understanding of the present invention. Next, a description of various aspects of the present invention is provided to give an understanding of the specific details.

(1) Introduction

The non-flushing urinals use virtually no water, relying on one of two types of traps to seal out gas and odor, the first is a mechanical trap with a mechanical odor barrier, and the second is a liquid, trap with a lighter-than-wastewater liquid barrier.

The present invention is intended to overcome many of the shortcomings associated with the liquid style traps, specifically the ability to introduce flushing water to the urinal without washing away the odor barrier provided by the oil layer which floats on the urine layer.

In order to clearly understand the benefits of the present invention, first features of the current systems are presented. For clarity, reference numbers of elements referred to in the prior art figures are affixed with "-P." Corresponding similar elements in figures pertinent to the present invention are not affixed. Thus, for example, reference number 100-P is used to indicate a cartridge housing in prior art figures, whereas reference number 100 is used to indicate a similar element in figures used to show aspects of the present invention.

Figure 1B:
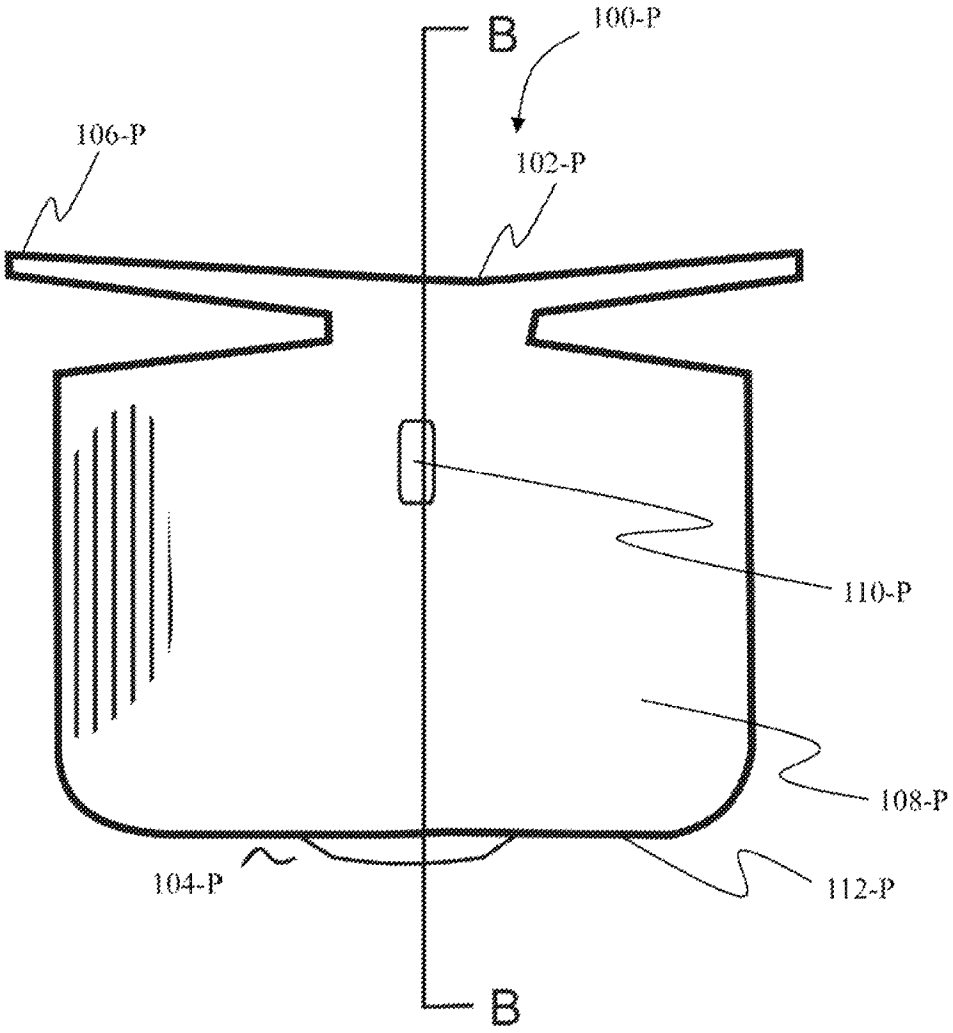
FIG. 1B PRIOR ART
FIG. 1B is a front view illustration of a prior art liquid trap cartridge for a waterless urinal.
Figure 1C:
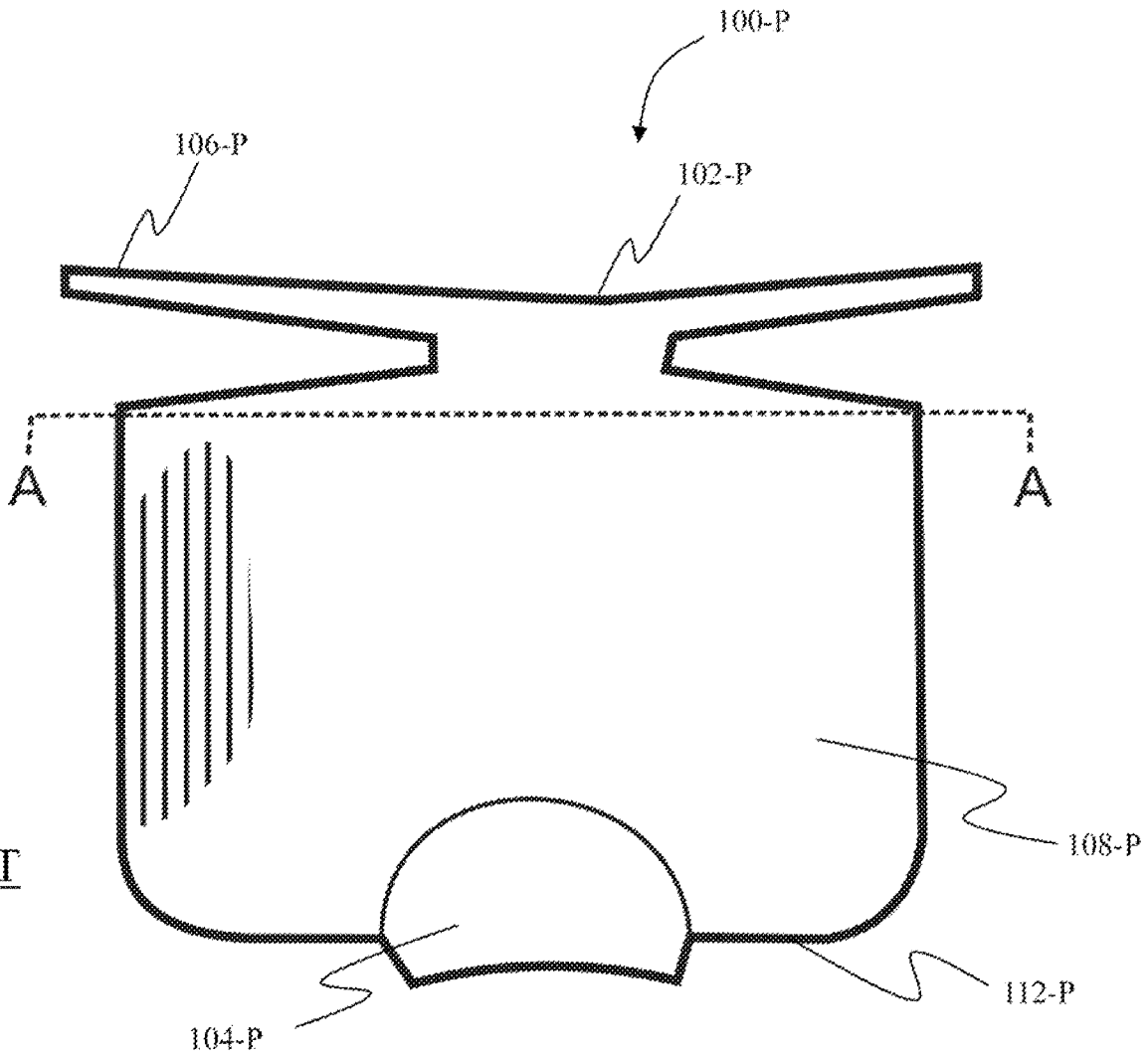
FIG. 1C PRIOR ART
FIG. 1C is a rear view illustration of a prior an liquid trap cartridge, for a waterless urinal.

An example of the exterior of a prior art cartridge 100-P is presented in FIGS. 1A to 1C. As shown in FIG. 1A, the cartridge 100-P includes a cartridge inlet 102-P for receiving incoming fluids and a cartridge exit 104-P for passing fluids out of the cartridge. The cartridge 100-P also includes a top wall flange 106-P for sealing the cartridge within a housing or a urinal (not shown). The cartridge 100-P further includes a cartridge side wall 108-P, that generally separates an exterior of the cartridge 100-P from an interior of the cartridge, as well as a locking tine 110-P for locking the cartridge 100-P within a housing or a urinal (again, not shown) and a bottom wall 112-P. The same exterior of the cartridge 100-P is shown in FIG. 1B in a front view and in FIG. 1C in a back view.

Figure 2:
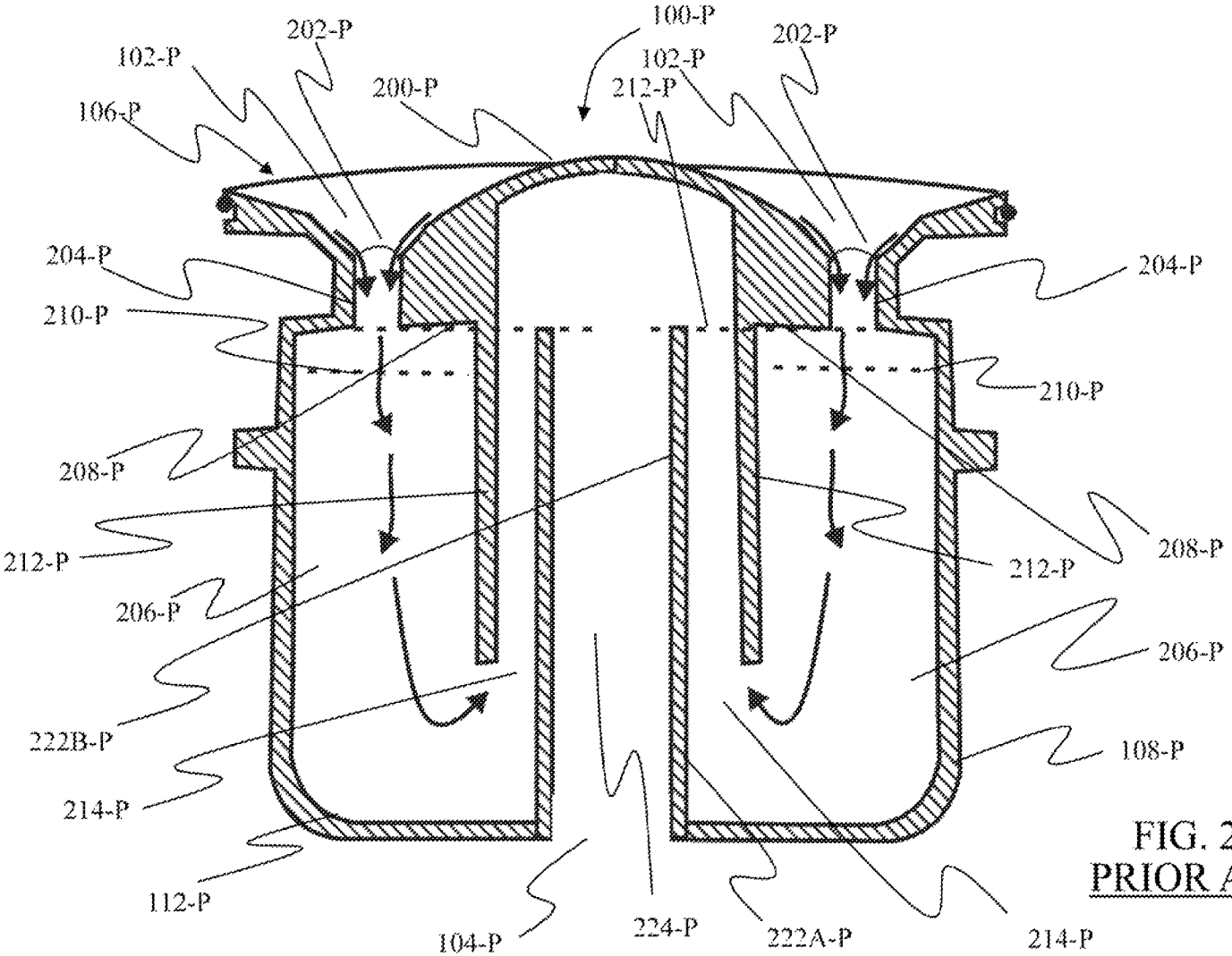
FIG. 2 PRIOR ART
FIG. 2 is a cross sectional view illustration of a prior art liquid trap cartridge with a central exit.

A cross sectional view of a prior art cartridge 100-P is shown in FIG. 2. In this cartridge 100-P, urine enters the cartridge 100-P through a plurality of inlets 102-P. A diverter 200-P is placed between the inlets 102-P to help direct urine to the inlets 102-P. A top trough 202-P is also provided to further direct urine to the inlets 102-P. After passing into the inlets 102-P, the urine passes through a throat 204-P and into an inlet compartment 206-P. As the urine passes below a ceiling 208-P of the inlet compartment 206-P, it encounters a fluid barrier 210-P. The fluid barrier 210-P is formed of a lighter-than-urine fluid, a non-limiting example of which is oil. In this case, the urine drips straight through the throat 204-P and impinges directly onto the fluid barrier 210-P, which can lead to a gradual loss of the fluid barrier 210-P. Also, if a large quantity of fluid is introduced to the cartridge 100-P, the fluid can rush through the throat 204-P and completely eliminate the fluid barrier 210-P, thus rendering the cartridge 100-P useless.

A vertical separator 212-P is provided to separate the inlet compartment 206-P from an outlet compartment 214-P. At the lower end of the vertical separator 212-P, a baffle 216-P is provided to help re-capture portions of the fluid barrier 210-P that are pushed down by incoming urine. The urine passes the baffle 216-P through a side gap 218-P formed between the baffle 216-P and the cartridge side wall 108-P. The urine in the outlet compartment 214-P rises until it reaches an overflow level 220-P, which is proximate the top of an outlet compartment vertical separator 222-P, which has a first side 222A-P and a second side 222B-P. The urine then flows through a discharge section 224-P and out through the cartridge exit 104-P and into a building's plumbing. The flow of the urine through the cartridge 100-P is shown by arrows.

Figure 3:
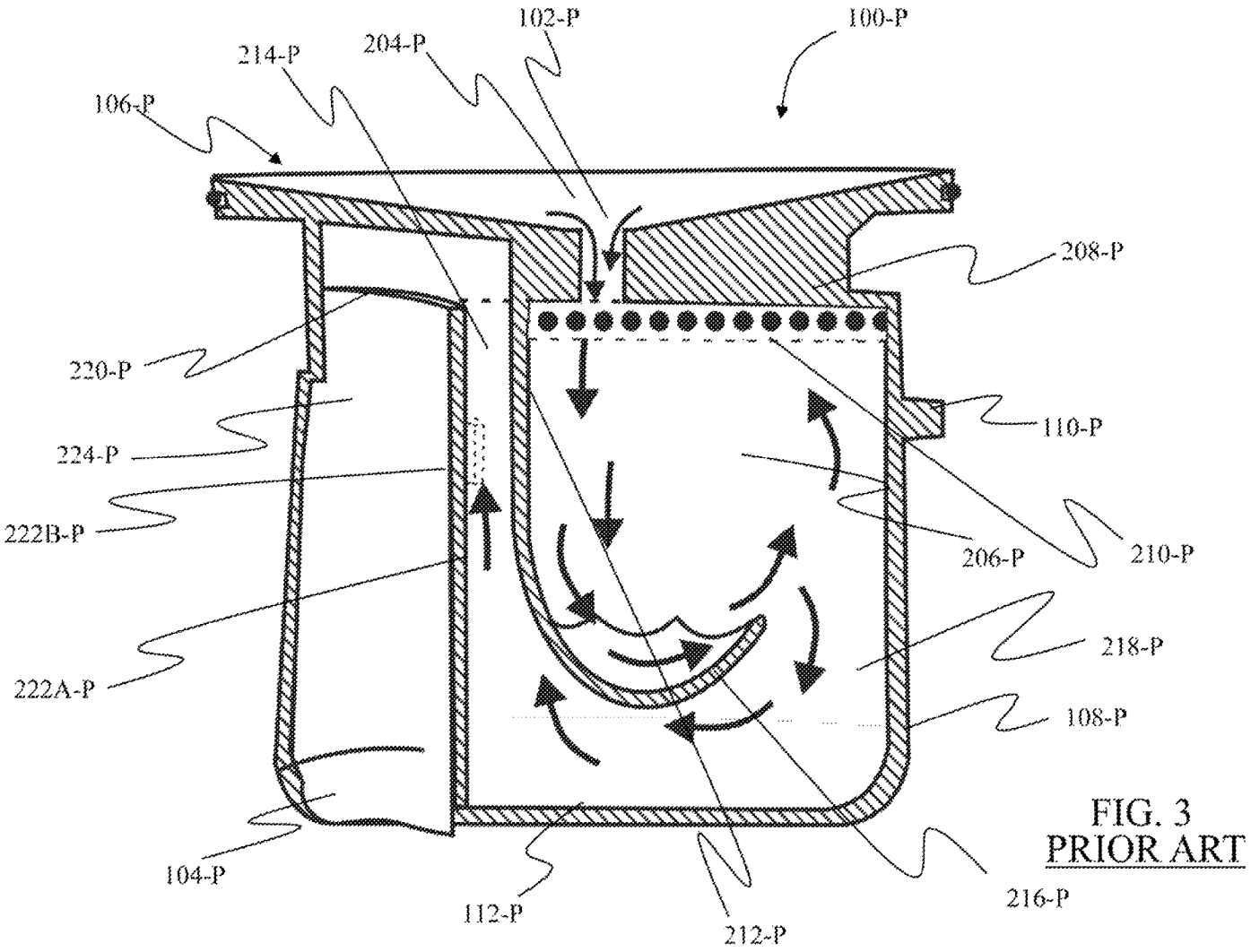
FIG. 3 PRIOR ART
FIG. 3 is a cross sectional view illustration taken from the side along, line B-B from FIG. 1B, of a prior art liquid trap cartridge for a waterless urinal with a central inlet and a side exit.

Another version of a prior art cartridge 100-P is shown in a cross sectional view in FIG. 3. In this version, the cartridge 100-P has a single inlet 102-P, but the function of the cartridge 100-P is essentially the same as the cartridge 100-P shown in FIG. 2. This cartridge 100-P has the same drawbacks as the previous cartridge 100-P; specifically, urine (or other fluids) impinge directly onto the fluid barrier 210-P, causing erosion or completely washing it away. Again, the flow of urine through the cartridge 100-P is shown by arrows.

Figure 4:
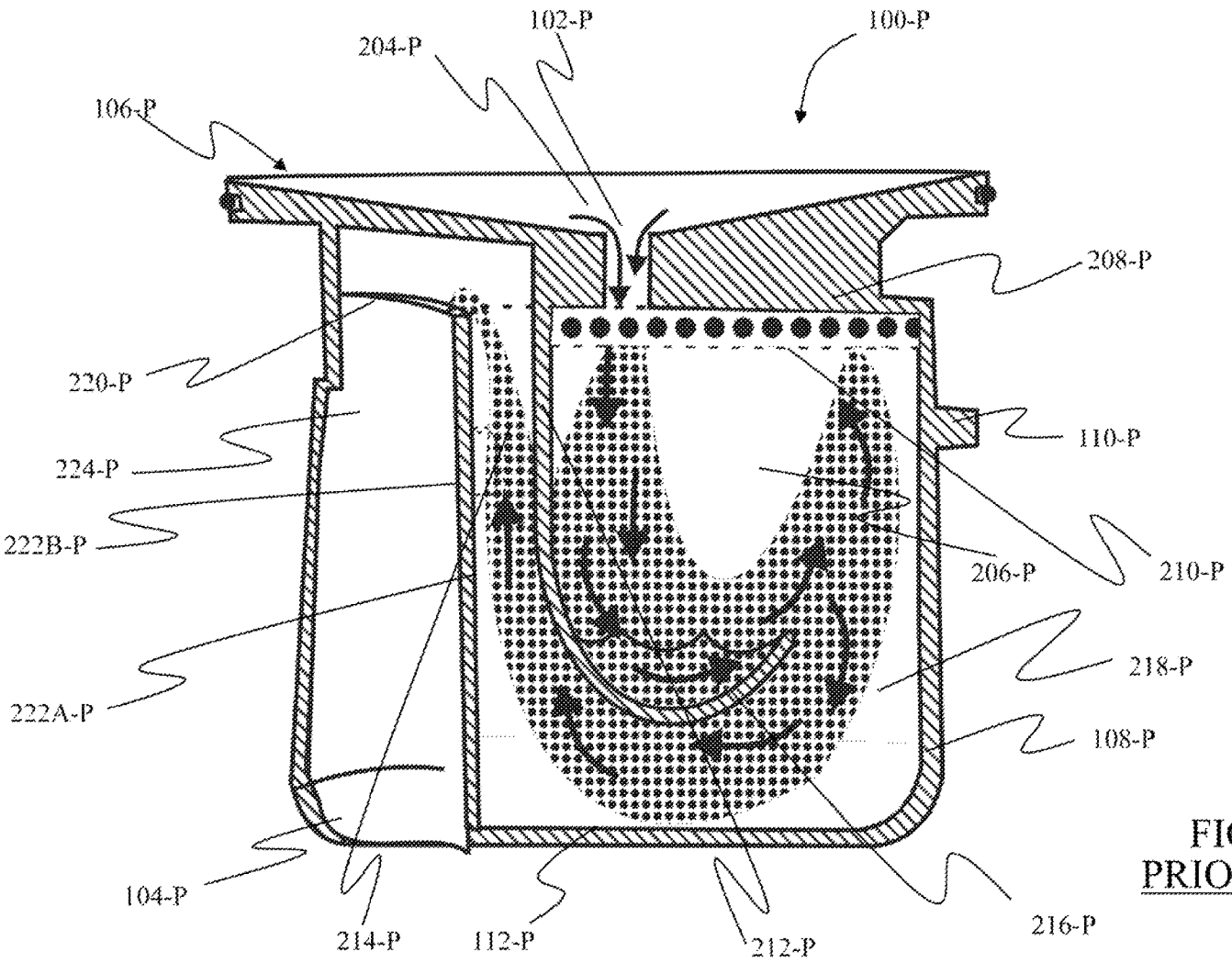
FIG. 4 PRIOR ART
FIG. 4 is a side cross section view illustration of a prior art rear exit.

The same cartridge 100-P of FIG. 3 is shown in FIG. 4, but with shading to indicate the passage of portions of the fluid barrier 210-P that are broken away by the downward pressure/impact of urine for other fluids) entering the cartridge 100-P. As can be seen, the baffle 216-P helps to re-direct some of the barrier fluid back to re-join the fluid barrier 210-P. However, a portion, or in catastrophic cases, all of the fluid barrier 210-P are washed away through the cartridge 100-P through the outlet compartment 214-P and through the cartridge exit 104-P.

The present invention provides mechanisms for overcoming the limitations of these prior art cartridges 100-P.

(2) Details of the Invention

Figure 5:
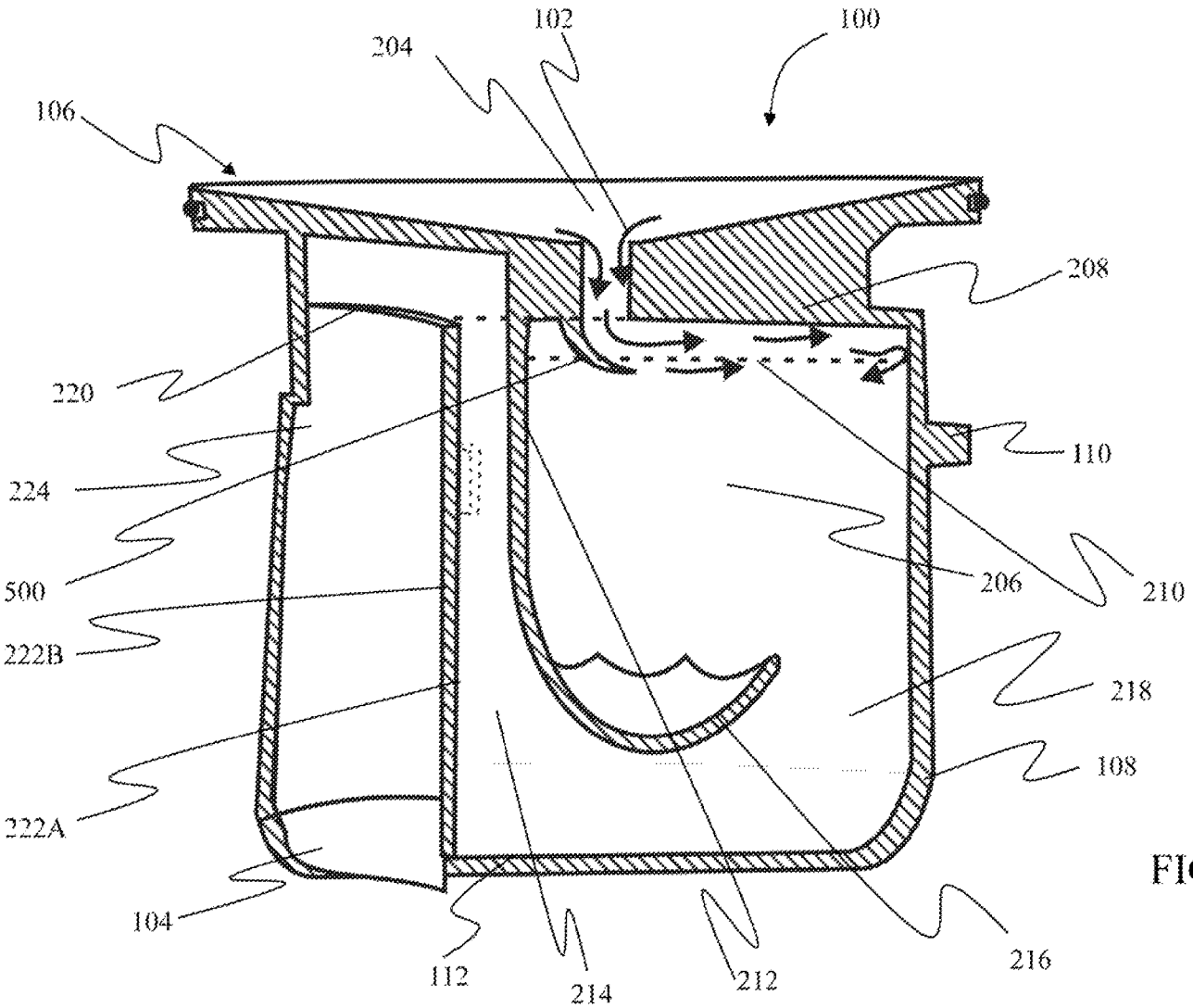
FIG. 5 is a side cross section view illustration of a center inlet cartridge with a horizontal jet, according to the present invention.

A cartridge 100 according, to the present invention is shown in FIG. 5. The cartridge 100 includes a fluid director 500 which is shaped to receive incoming urine and impart it with a horizontal velocity component while minimizing splashing and turbulence. The fluid director 500 is positioned proximate the throat portion 204 of the cartridge 100. As shown, the fluid director 500 is a non-linear surface, curved so that it gradually changes the direction of incoming fluid. The fluid director 500 may also be formed such that when in use, it is in fluid communication with the fluid barrier 210. In the case shown in FIG. 5, the fluid director 500 passes through the fluid barrier 210, so that incoming fluid is gently guided beneath the fluid barrier 210 in a substantially uniform direction, while minimizing disruption of the fluid barrier 210.

Although the fluid director 500 of FIG. 5 is shown as being concave with respect to the throat 204 of the cartridge 100, it may also be formed convexly or in any manner suitable to a particular cartridge 100. As shown further below, the fluid director 500 may also be formed to impart a substantially horizontal swirling motion to fluid within the cartridge 100.

Figure 6:
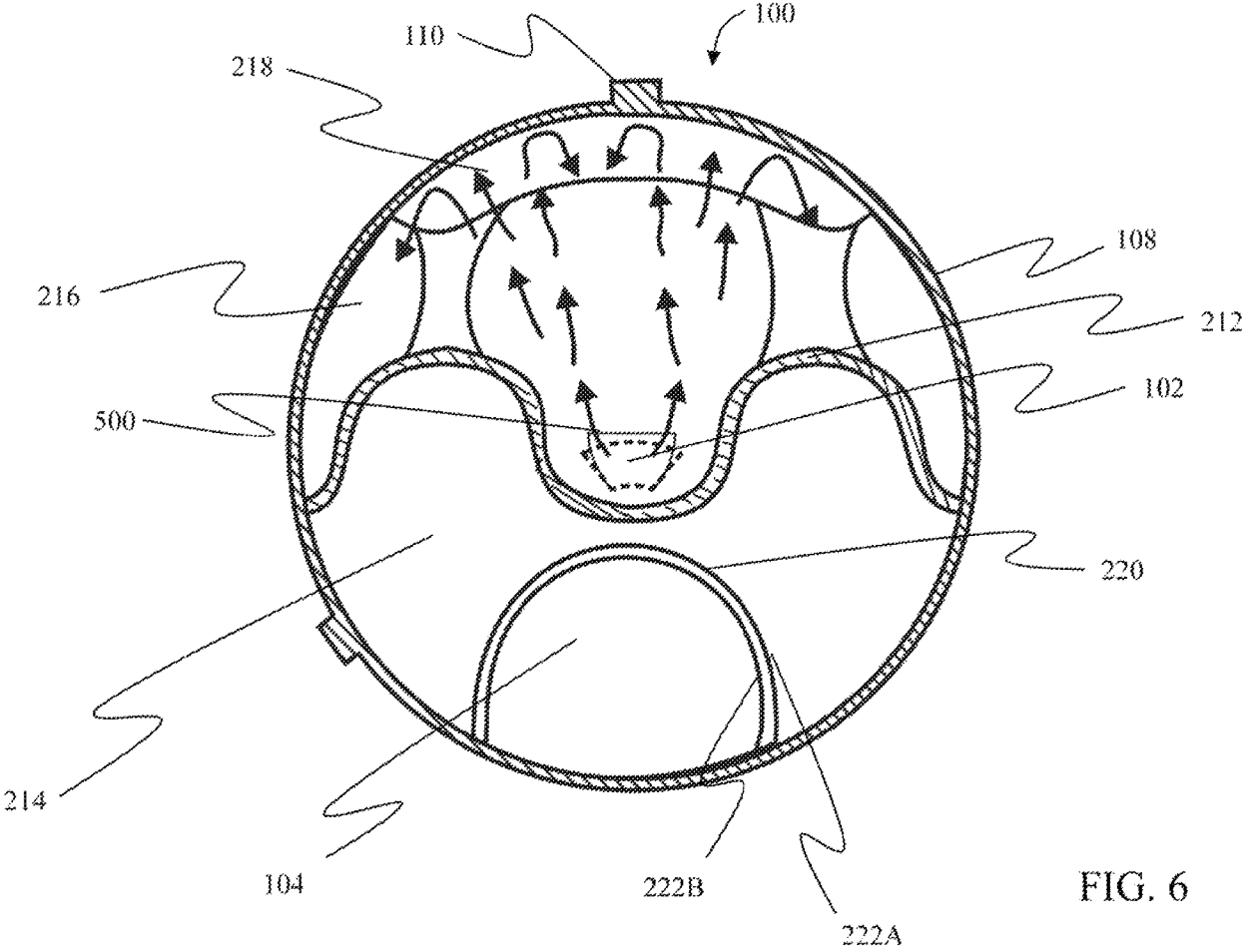
FIG. 6 is a top cross section view illustration of a cartridge having a rear or side exit, according to the present invention.

A top view cross-section of the cartridge 100 of FIG. 5 is presented in FIG. 6. In this case, the cross-section is taken proximate the fluid barrier 210. Urine passes through the inlet 102 of the cartridge 100 and encounters the fluid director 500. Arrows show how the urine is directed with a horizontal velocity component toward a portion of the cartridge side wall 108 (in this case, toward an area of the cartridge side wall 108 proximate the locking tine 110).

Figure 7:
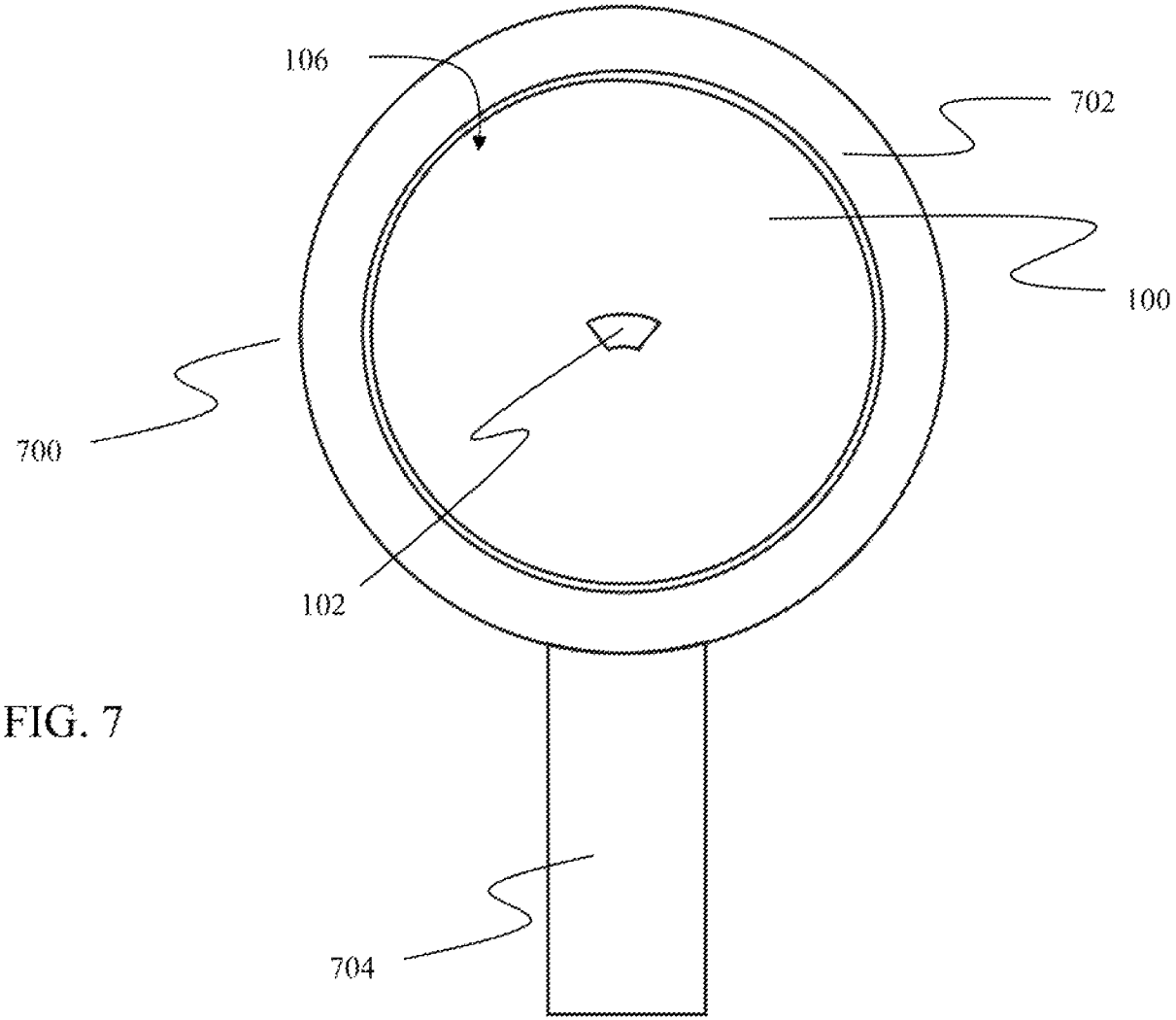
FIG. 7 is a top view illustration of a central inlet cartridge placed into a housing, according to the present invention.

The cartridge 100 of FIG. 5 and FIG. 6 is shown in FIG. 7 fitted in a housing body 700 from a top view. The housing body 700 includes a housing flange 702 for interfacing with a porcelain urinal and for guiding urine to the cartridge 100. A housing exit tube 704 receives urine from the cartridge exit 104 (not shown) and passes the urine to a building's plumbing (not shown).

Figure 8:
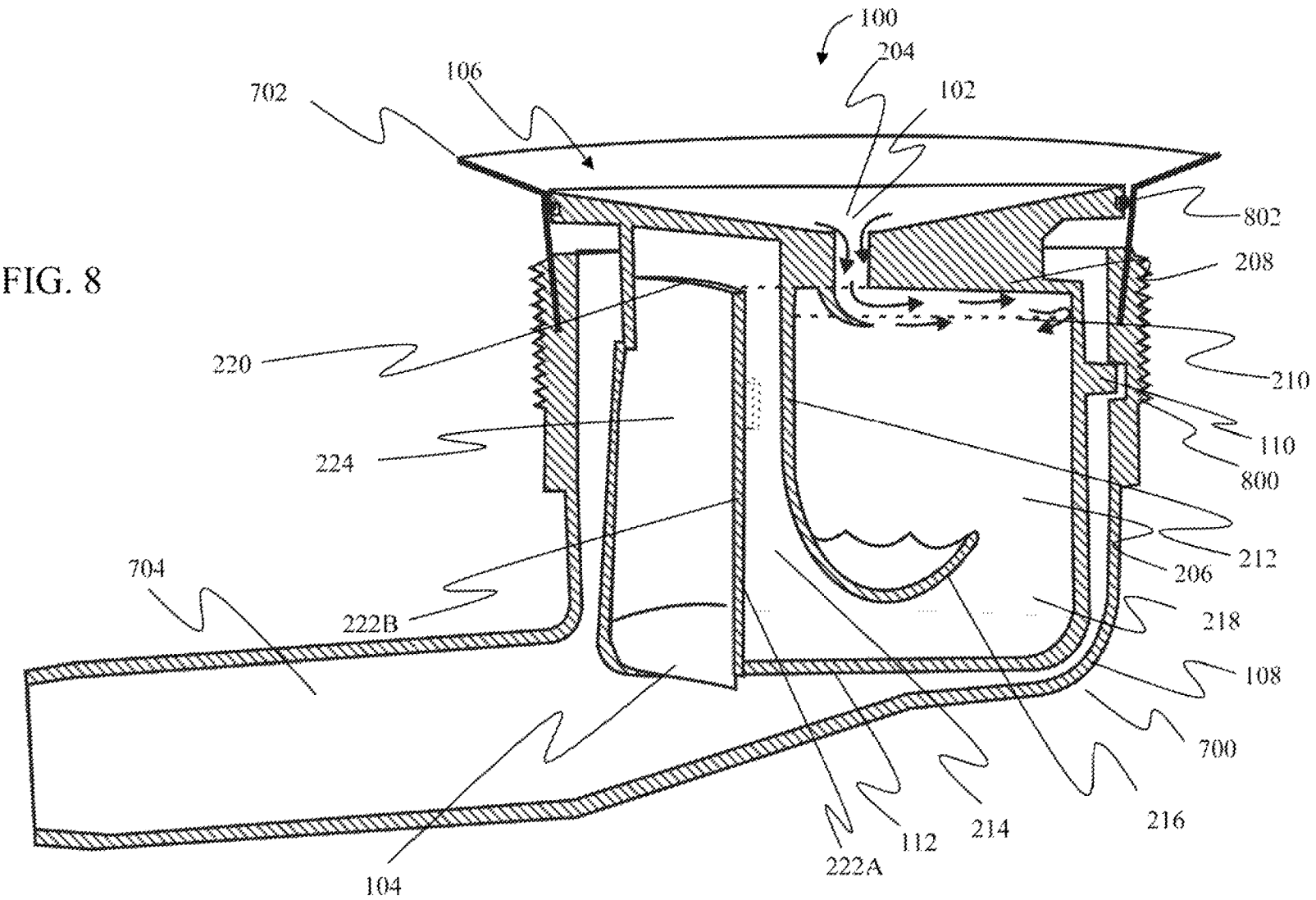
FIG. 8 is a side cross section view illustration of a center inlet, cartridge with a horizontal jet placed in a housing, according to the present invention.

The cartridge 100 of FIG. 5 and FIG. 6 is shown fitted in the housing body 700 of FIG. 7 in a side cutaway view in FIG. 8. When the cartridge 100 is inserted into the housing 700 and turned, the locking tines 110 of the cartridge 100 mate with locking tine keyways 800 to bold the cartridge 100 in place. An O-ring 802 around the cartridge 100 helps to form a liquid tight seal between the cartridge 100 and the housing body 700.

Figure 9:
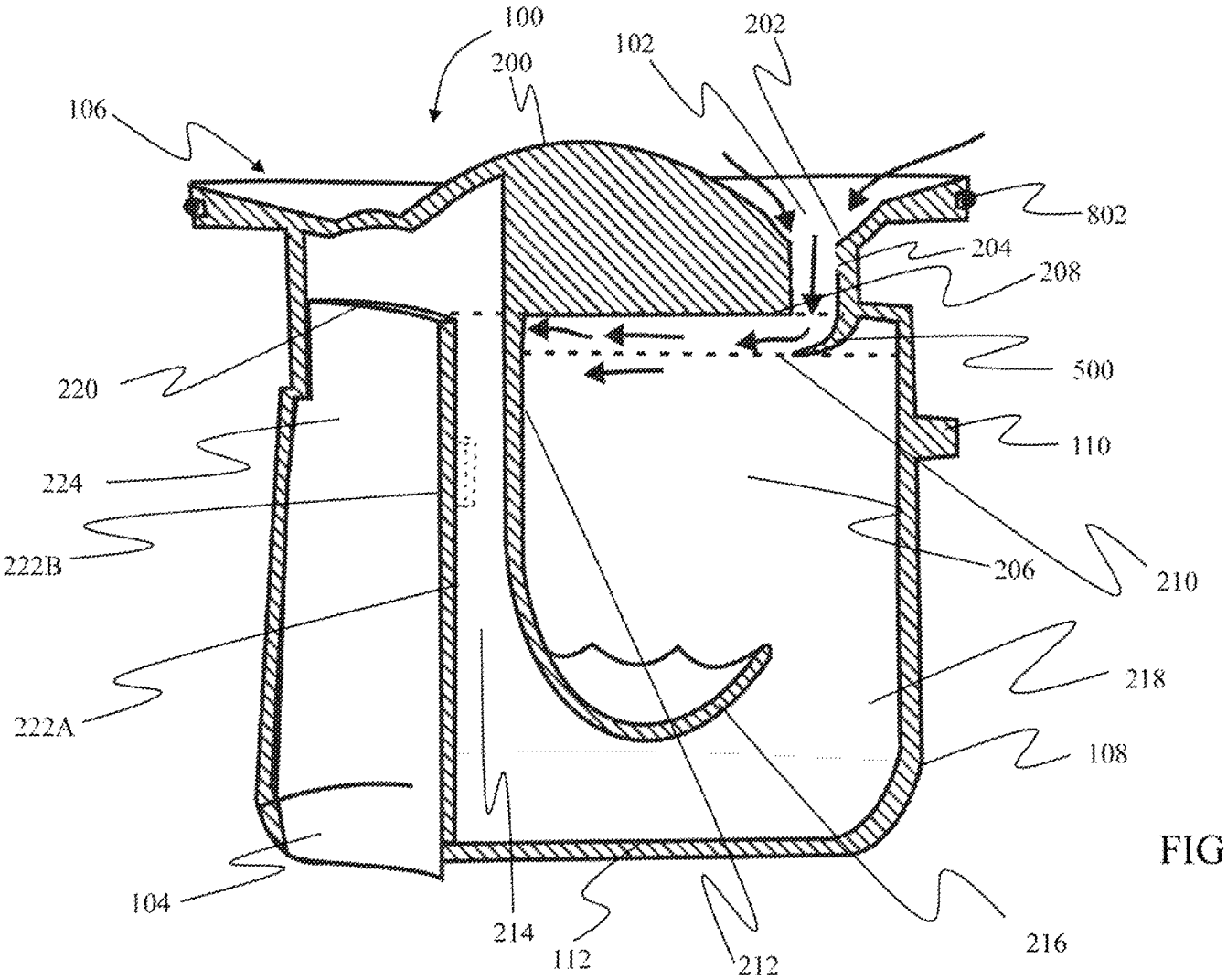
FIG. 9 is a cross sectional view illustration of the invention, applied to a cartridge which has a side it and an off center inlet, according to the present invention.
Figure 10:
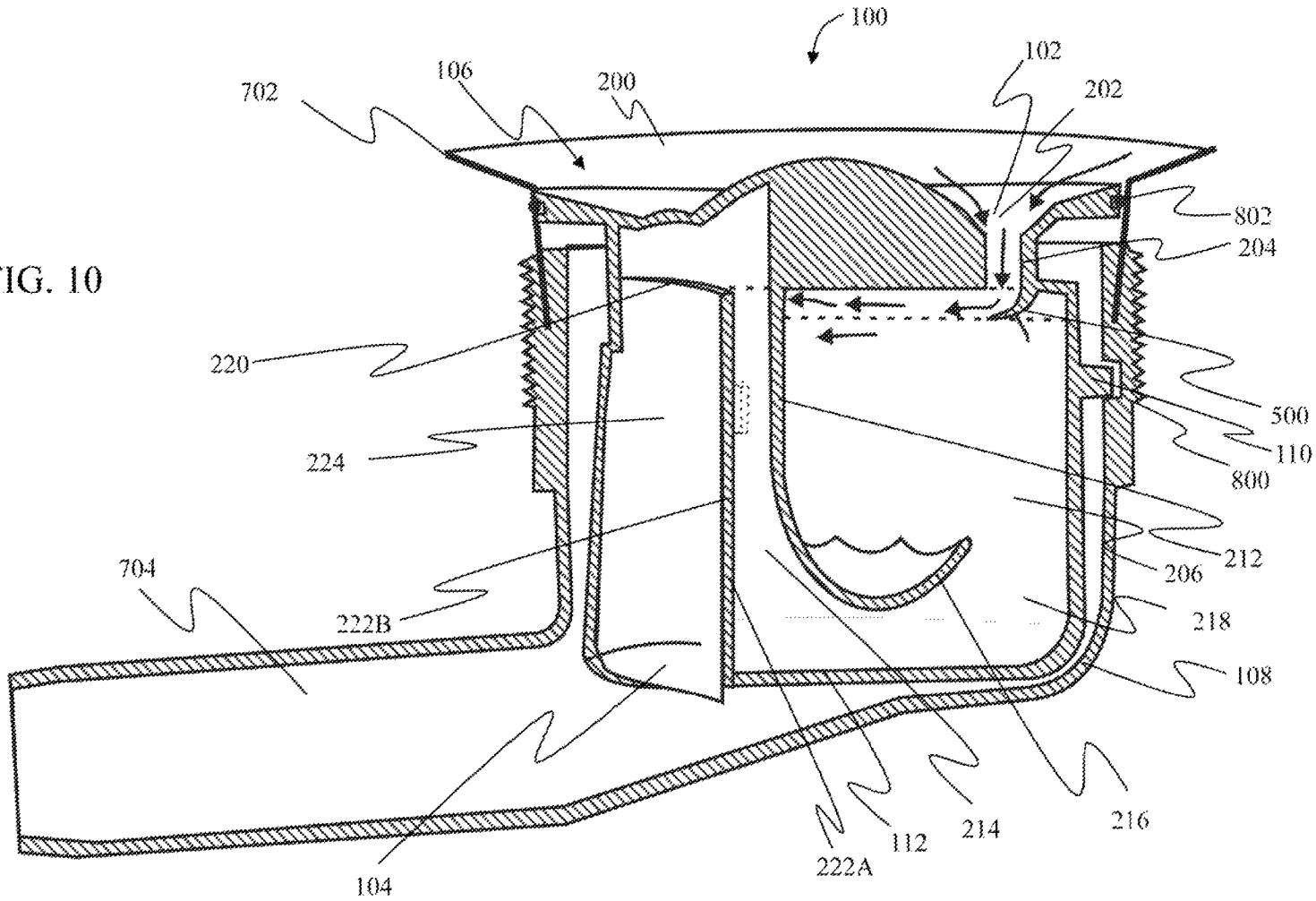
FIG. 10 is a cross sectional side view illustration of the cartridge placed in a housing, according to the present invention.

A cartridge 100 similar to that shown in FIG. 5 and FIG. 6 is shown in FIG. 9. In this case, the fluid director 500 directs incoming urine (or other fluids) from an inlet 102 near the cartridge side wall 108 toward the vertical separator 212. As previously mentioned, the fluid director 500 imparts a horizontal velocity component to incoming urine to avoid disrupting the fluid barrier 210. As will be shown further below, one or more fluid directors 500 may be used and may direct fluid in any desired (horizontal) direction within the cartridge 100. The same cartridge 100 is shown within a housing body 700 in FIG. 10.

Figure 11:
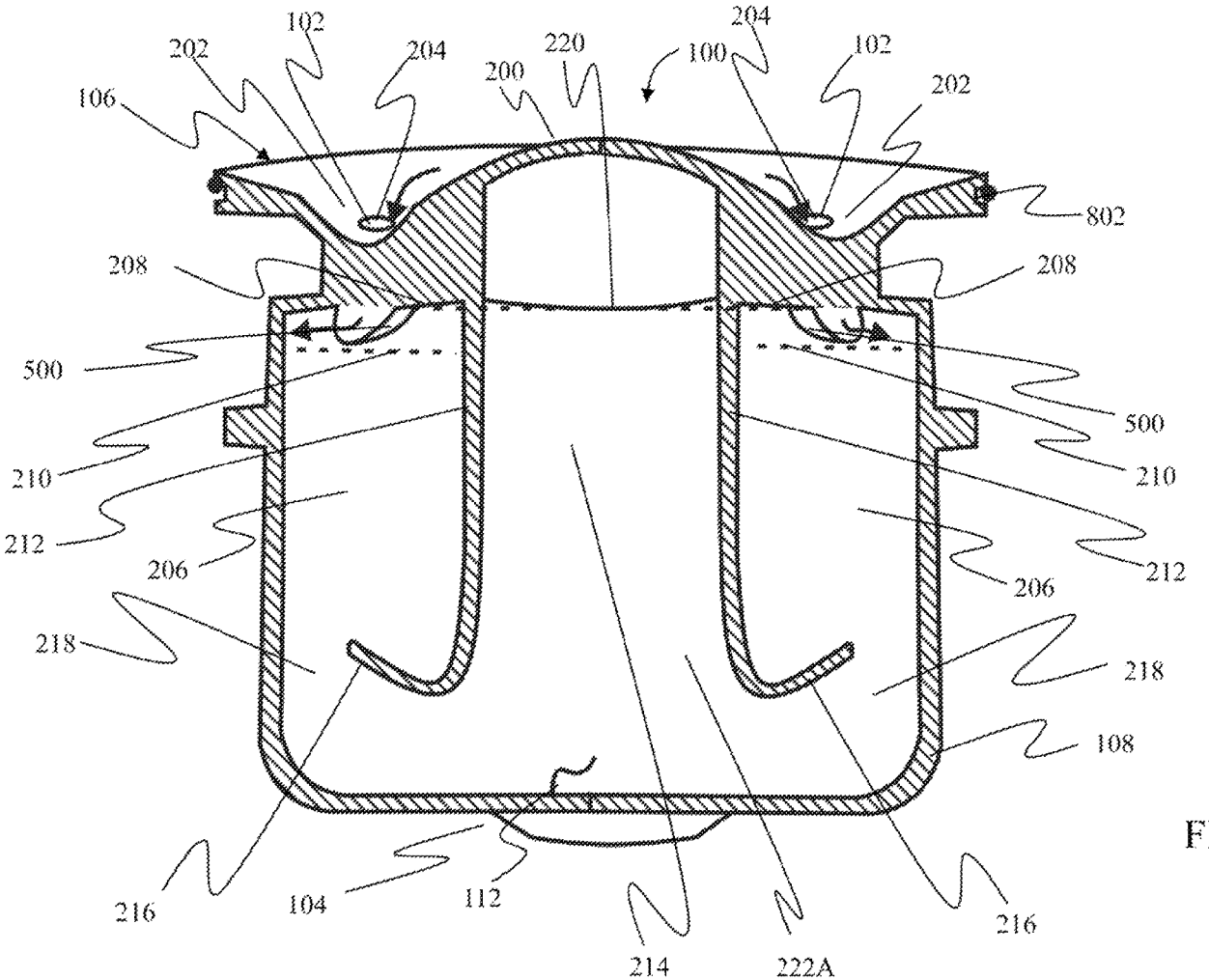
FIG. 11 is a cross sectional view illustration of the cartridge, this time along line C-C as depicted in FIG. 1A, according to the present invention.
Figure 12:
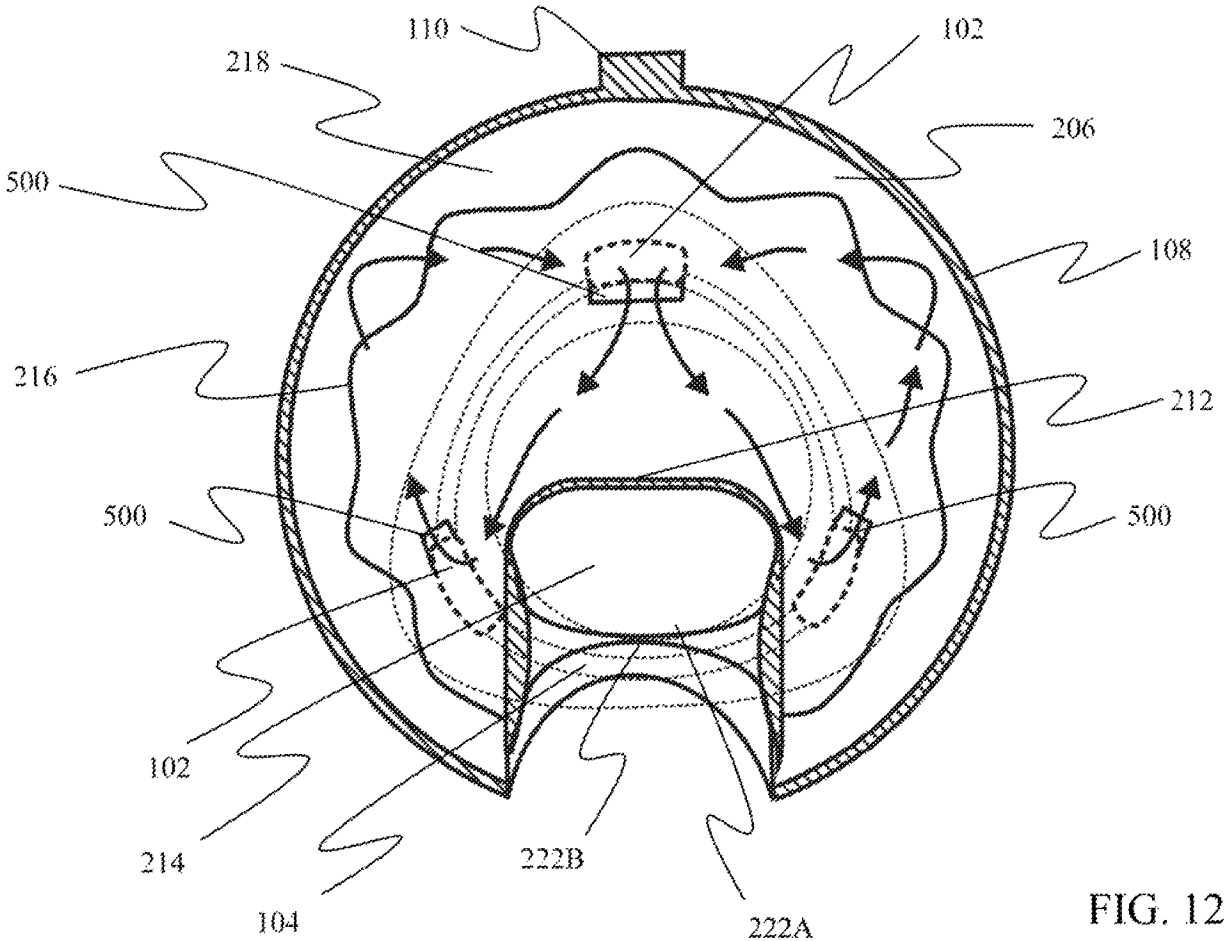
FIG. 12 is a cross section top view illustration of the cartridge, according to the present invention.
Figure 13:
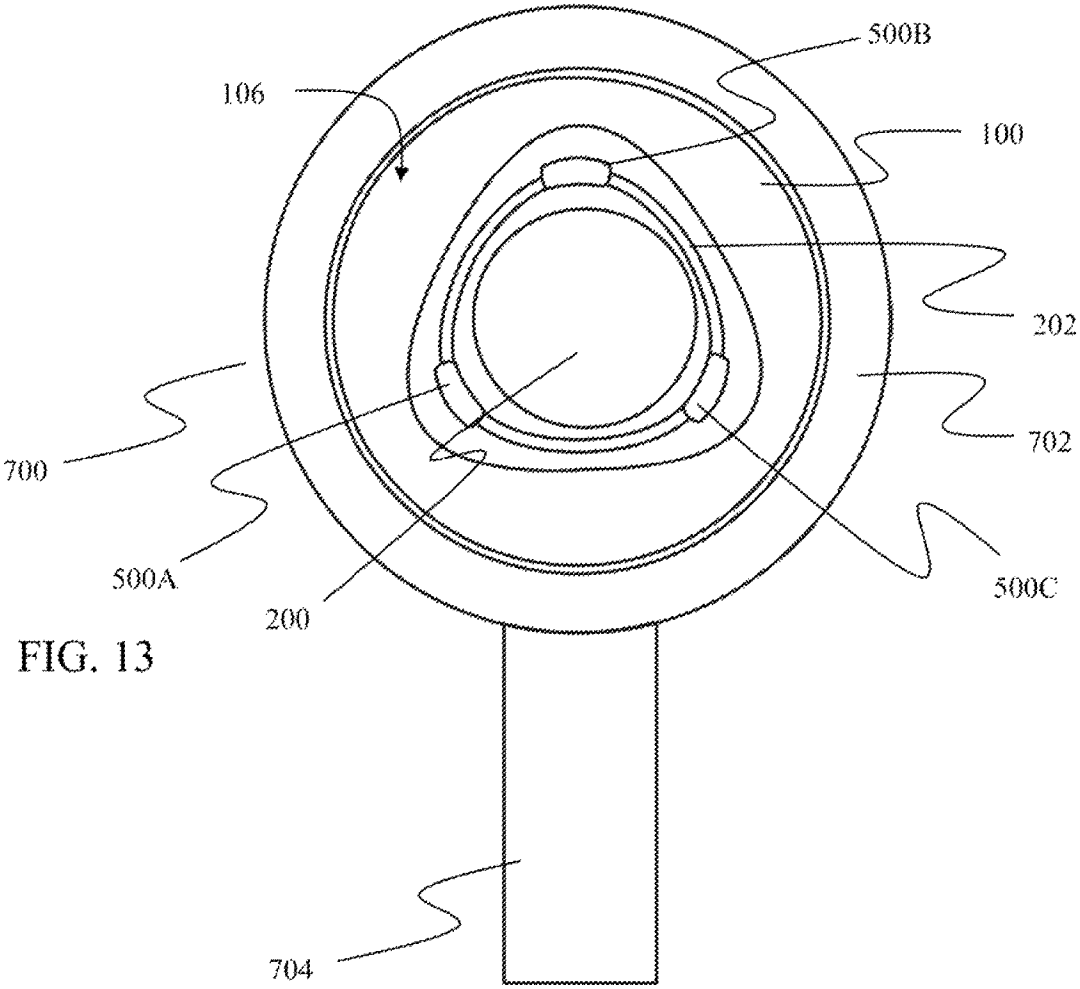
FIG. 13 is a top view illustration of a cartridge placed in a housing, according to the present invention.

A cross-sectional side view of a cartridge 100 having three inlets 102 is shown in FIG. 11. In this case, the inlets 102 are formed within a top trough 202. Fluid directors 500 are angled to provide for fluid circulation within the cartridge 100 as shown in FIG. 12. FIG. 12 is a top cross-sectional view taken at the level of the fluid barrier 210. The fluid directors 500A-500C provide for the fluid flow pattern depicted by the arrows. In this case, fluid directors 500A and 500B direct incoming fluid toward roughly opposite portions of the cartridge side wall 108, while fluid director 500C directs fluid in two directions, roughly toward fluid directors 500A and 500B, thus causing two areas of fluid circulation. The cartridge 100 of FIG. 11 and FIG. 12 is shown installed in a housing body 700 in a cross-sectional view in FIG. 13.

Figure 14:
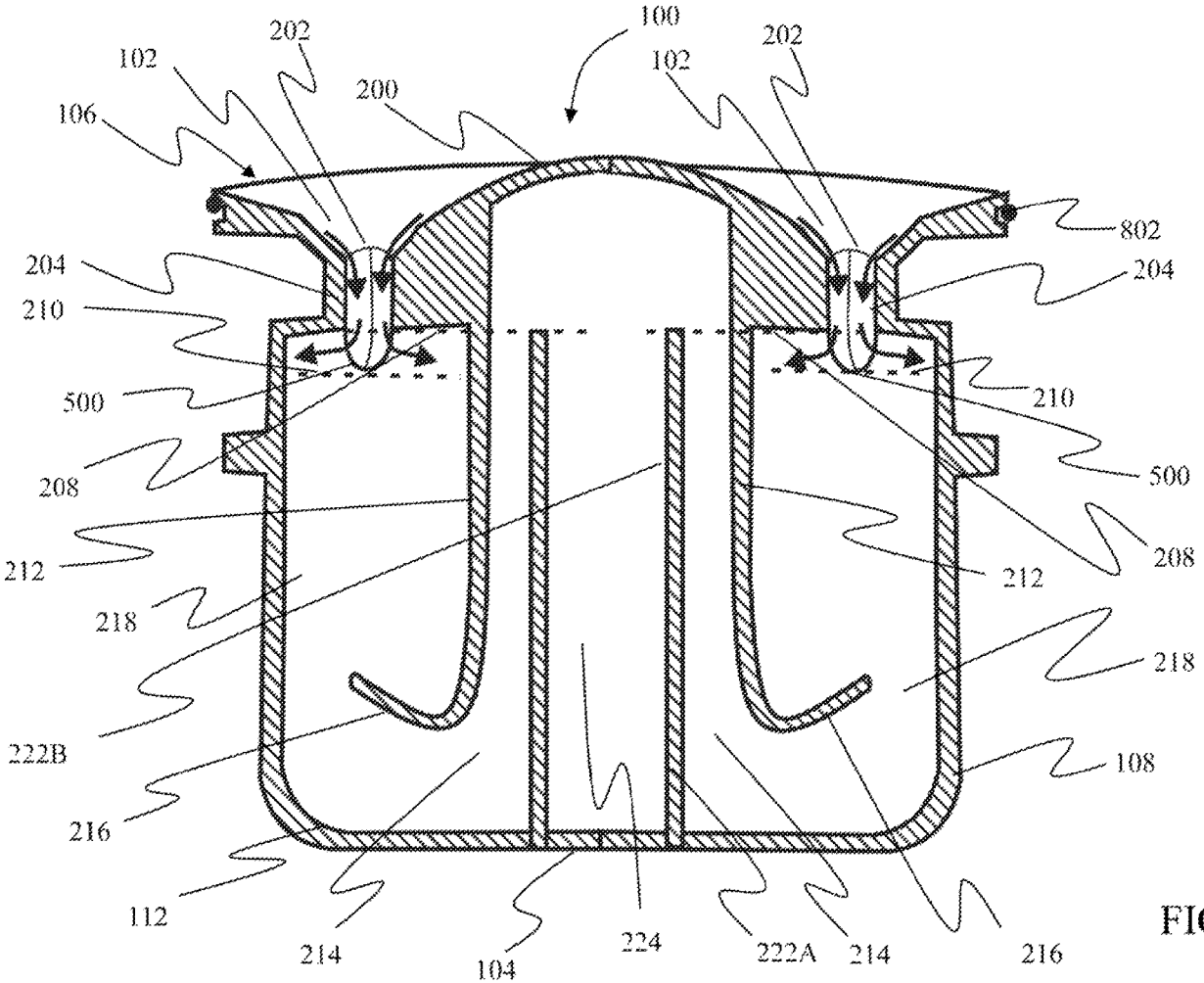
FIG. 14 is a cross sectional view illustration of a central exit type cartridge with jets added, according to the present invention.
Figure 15:
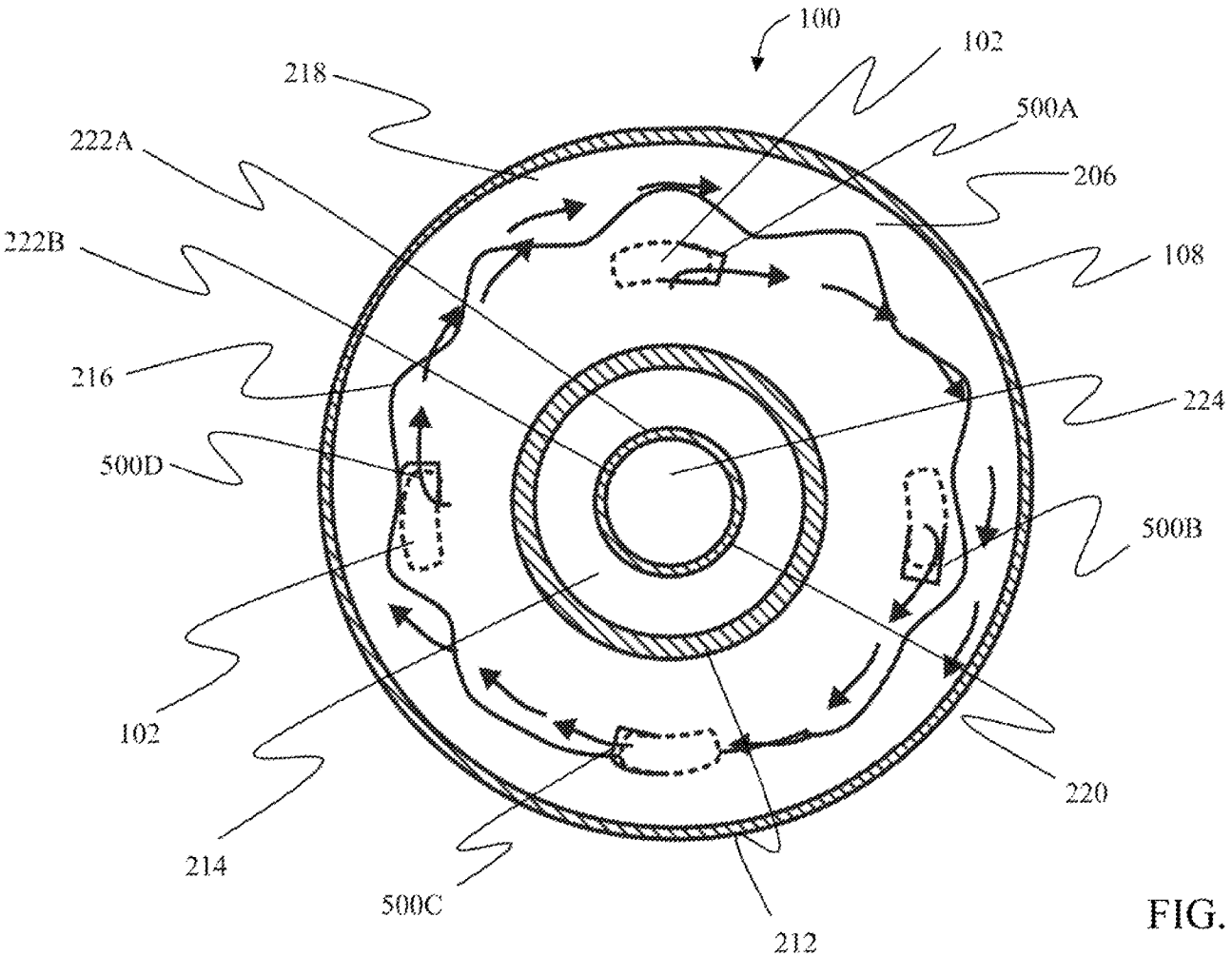
FIG. 15 is a top cross section view illustration of a center exit ridge without cross section, according to the present invention.
Figure 16:
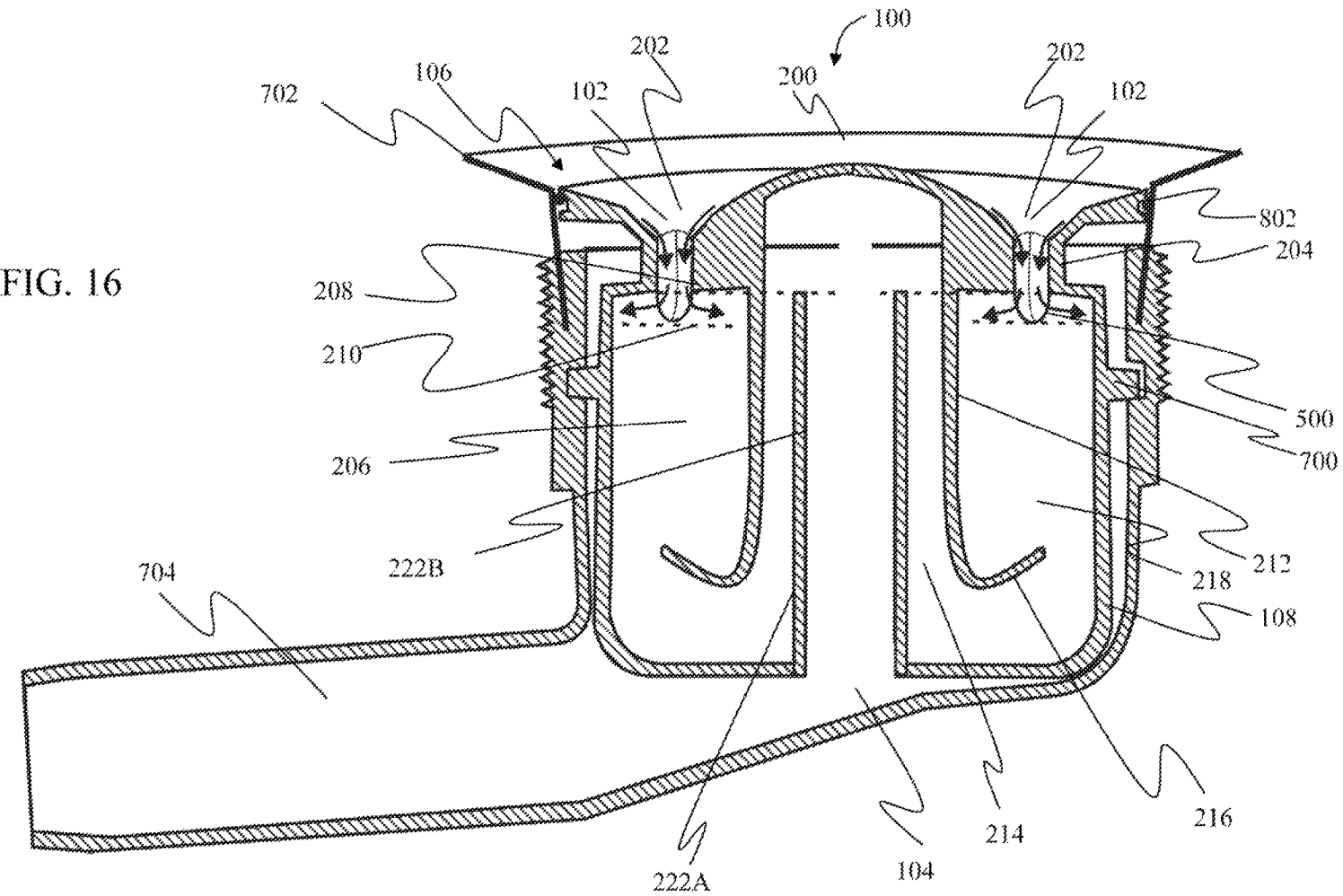
FIG. 16 is a cross sectional view illustration of a central exit type cartridge placed into a housing, according to the present invention.
Figure 17:
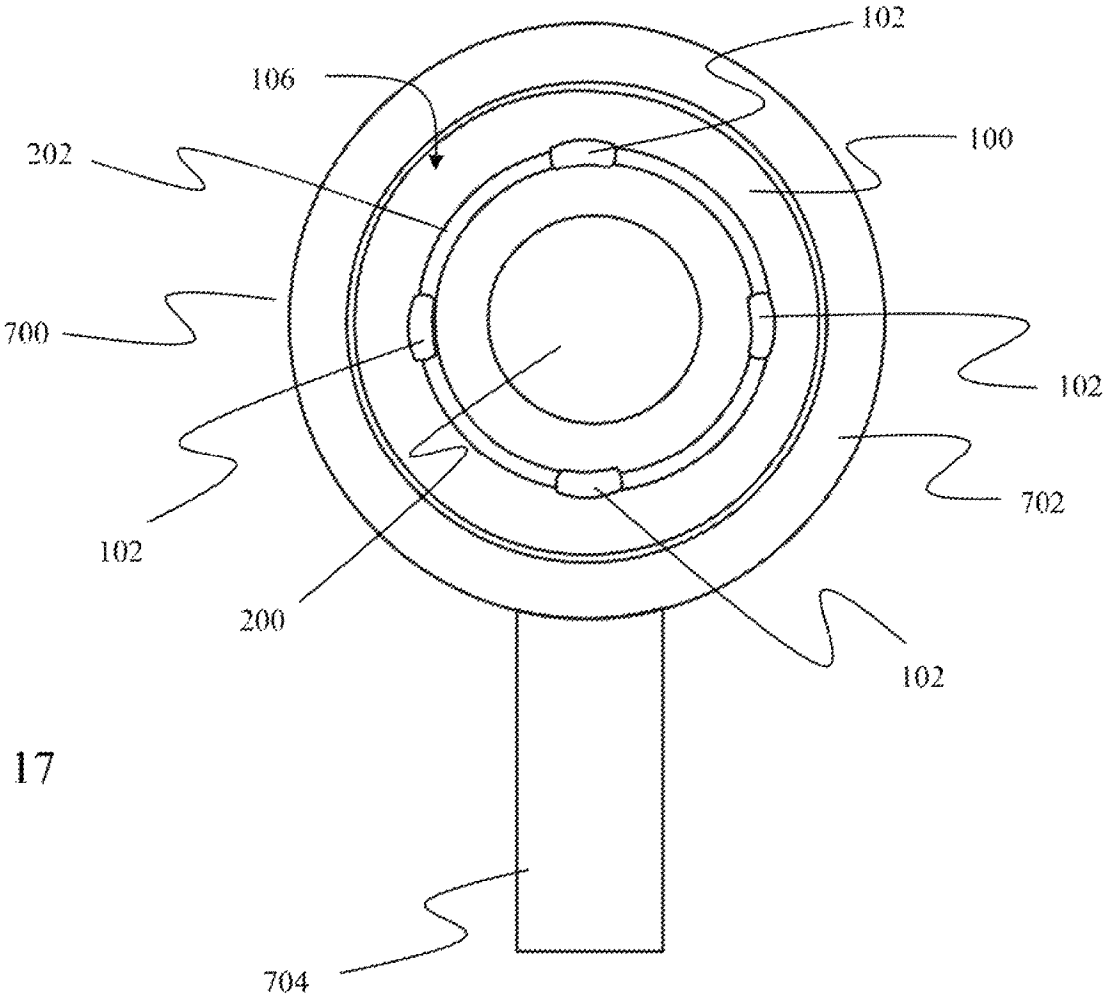
FIG. 17 is a top view illustration of a cartridge placed in a housing, according to the present invention.

A cross-sectional side view of a cartridge 100 having four inlets 102 is shown in FIG. 14. In this case, the inlets 102 are touted within a top trough 201. The fluid directors 500 are angled to provide for fluid circulation within the cartridge 100 as shown in FIG. 15. FIG. 15 is a top cross-sectional view taken at the level of the fluid barrier 210. The fluid directors 500A-500D provide for the fluid flow pattern depicted by the arrows. In this case, with respect to the view shown in FIG. 15, fluid director 500A directs incoming fluid to the right side of the figure; fluid director 500B directs incoming fluid toward the bottom side of the figure; fluid director 500C directs incoming fluid toward the left side of the figure; and fluid director 500D directs incoming fluid toward the top side of the figure. Thus, fluid within the cartridge is directed in the clockwise pattern as shown. The cartridge of FIG. 14 and FIG. 15 is shown installed in a housing body 700 in a cross-sectional view in FIG. 16 and in a top view in FIG. 17.

Figure 18:
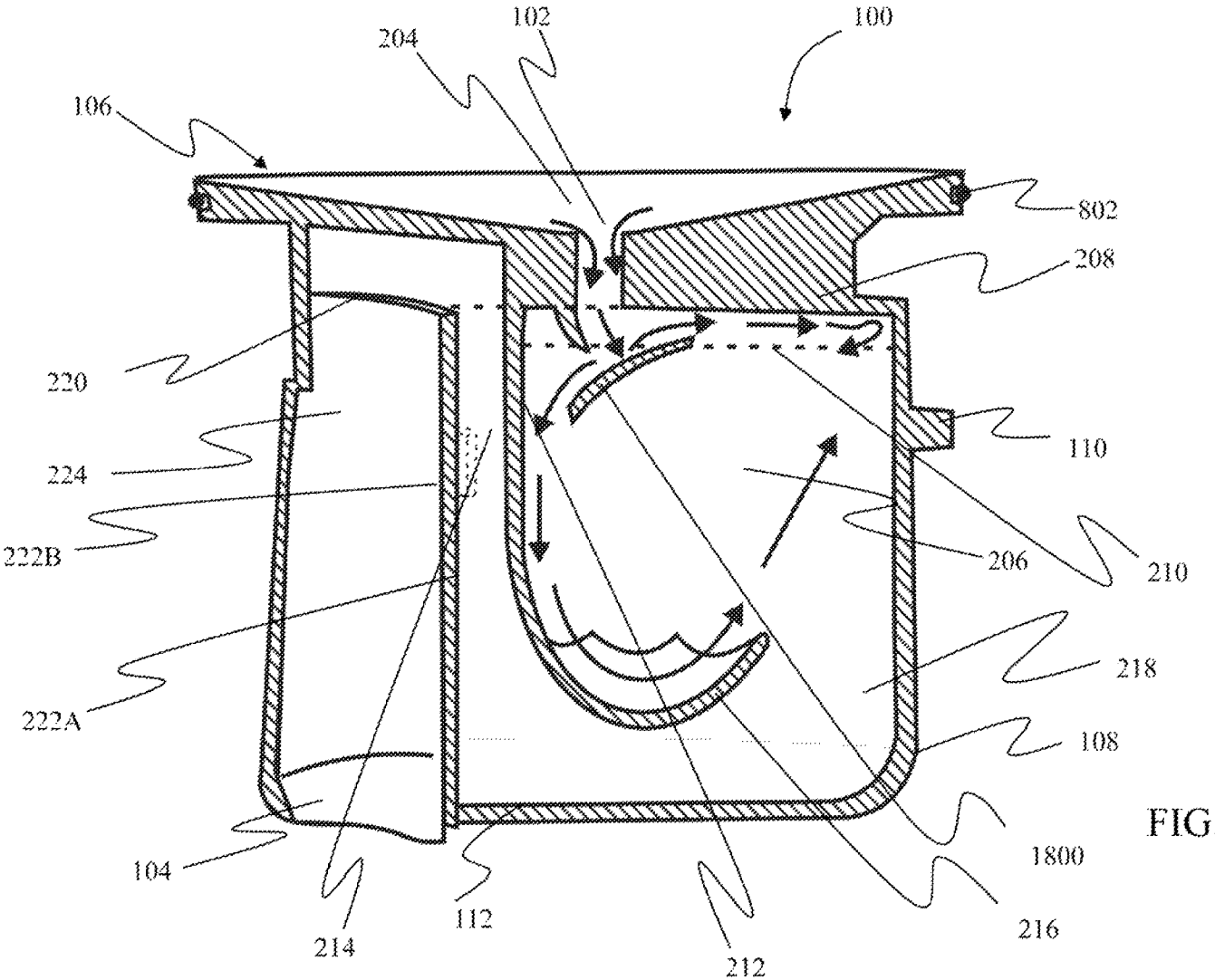
FIG. 18 is a side cross section view illustration of another embodiment of the invention where a deflector has been added to a central inlet style cartridge, according to the present invention.

A cartridge 100 similar to that shown in FIG. 5 is shown in FIG. 18. In this case, a fluid deflector 1800 is positioned proximate the fluid director 600 for receiving and re-directing fluid therefrom. The fluid deflector 1800 can deflect the fluid with an upward vertical velocity component and with a downward vertical velocity component as shown in FIG. 18. The fluid deflector 1800 can also deflect the fluid with a further horizontal velocity component. Also a portion of the fluid deflector 1800 can reside within the fluid barrier 210. The fluid deflector 1800 can also be formed such that the whole fluid deflector 1800 resides within the fluid barrier

210 or such that the whole fluid deflector 1800 resides beneath the fluid barrier 210. In the case shown in FIG. 18, the fluid deflector 1800 is separate from the vertical separator 212 such that a gap exists there-between. The fluid deflector 1800 is also formed such that a gap exists between the fluid deflector 1800 and the cartridge body wall 108. Note that, as shown below, cartridges 100 that include a fluid deflector 1800, but without a fluid director 500 may also be provided without departing from the scope of the present invention.

Figure 19:
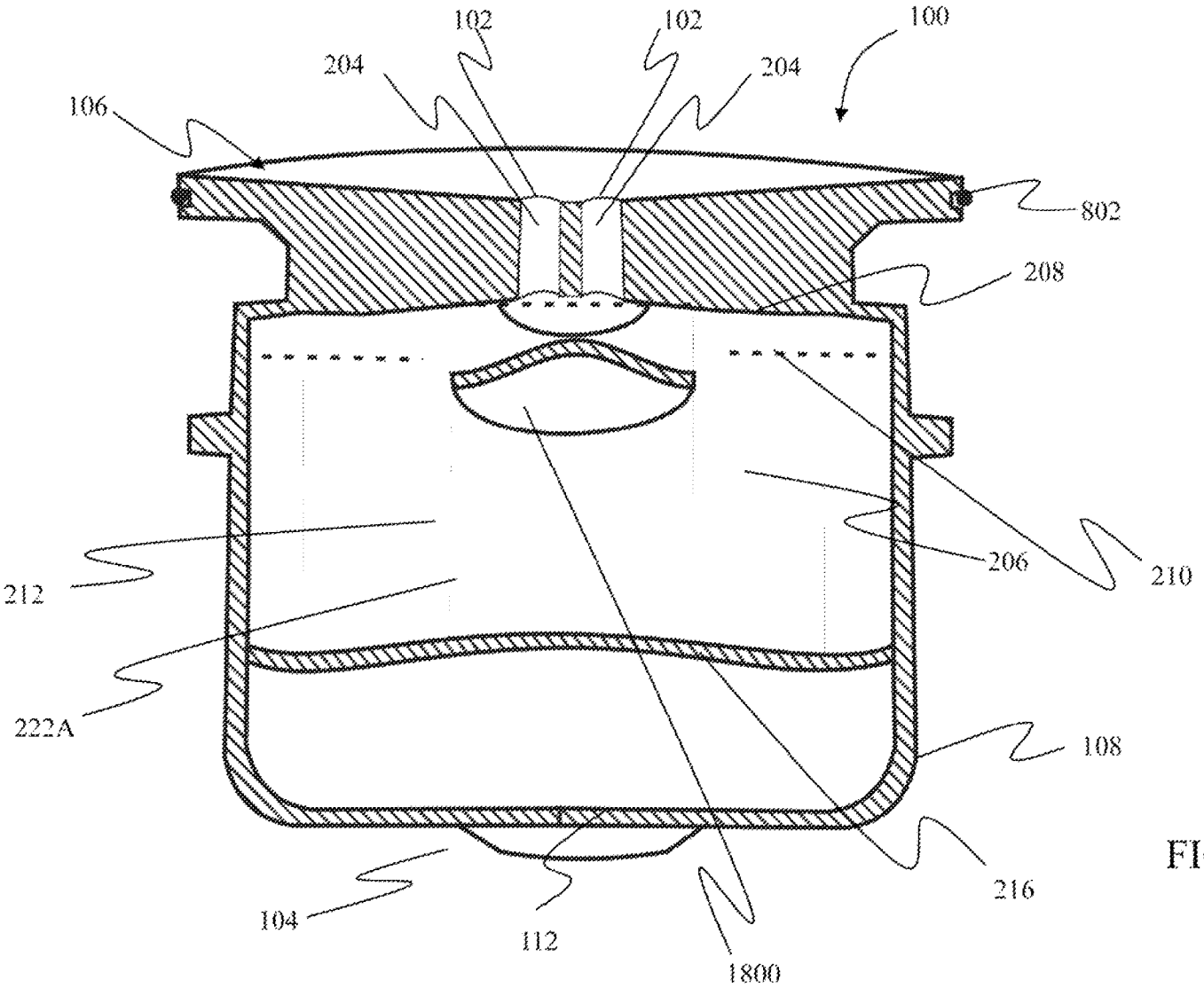
FIG. 19 is a side cross section view illustration of the cartridge as depicted in FIG. 18, without an inlet jet and with multiple inlets, according to the present invention.

Another cartridge 100 having a fluid deflector 1800 is shown in FIG. 19. In this case, the cartridge 100 has multiple, centrally located, inlets 102. The deflector 1800 is convex with regard to the area between the inlets 102 and is concave with regard to where the fluid flowing through them. As a result fluid from the left inlet 102 is deflected to the left and fluid from the right inlet is deflected to the right.

ELEMENTS LIST

The following list of elements is provided for ease of reference.

100—Cartridge
102—Inlet
104—Cartridge Exit
106—Top Wall Flange
108—Cartridge Side Wall
110—Locking Tine
112—Bottom Wall
200—Built-in Diverter
202—Top Trough
204—Throat
206—Inlet Compartment
208—Ceiling
210—Fluid Barrier
212—Vertical Separator
214—Outlet Compartment
216—Baffle
218—Side Gap
220—Overflow Level
222—Outlet Compartment Vertical Separator
222A—Outlet Compartment Vertical Separator (A back of wall, first side)
222B—Outlet Compartment Vertical Separator (B front of wall, second side)
224—Discharge Section
500—Fluid Director
700—Housing Body
702—Housing Flange
704—Housing Exit Tube
800—Locking Tine Keyway
802—O-Ring
1800—Fluid Deflector

What is claimed is:

1. A waterless urinal cartridge, the waterless urinal cartridge comprising:
an inlet for receiving urine;
an inlet compartment;
a throat portion residing between the inlet and an inlet compartment;
a cartridge side wall surrounding the inlet compartment;
a curved fluid director extending from a top of the inlet compartment and into an area of the inlet compartment directly below the throat portion,
wherein the curved fluid director is formed for receiving the urine from the throat portion and gradually directing the urine with a horizontal velocity component toward a portion of the cartridge side wall,
wherein the curved fluid director extends in a direction substantially parallel with a top and a bottom of a barrier fluid layer residing therein.

2. The waterless urinal cartridge as set forth in claim 1, wherein the curved fluid director is formed such that it is in fluid communication with at least a portion of the barrier fluid layer residing therein.

3. The waterless urinal cartridge as set forth in claim 2, where the curved fluid director is configured to direct urine flowing through the throat portion beneath the barrier fluid layer in a substantially uniform direction.

4. The waterless urinal cartridge as set forth in claim 1, where the curved fluid director comprises a surface-type selected from a group consisting of convex and concave.

5. The waterless urinal cartridge as set forth in claim 1, wherein the curved fluid director is formed to gradually change a direction of the urine received from the throat portion.

* * * * *